US009717301B2

(12) United States Patent
Peikert et al.

(10) Patent No.: US 9,717,301 B2
(45) **Date of Patent: *Aug. 1, 2017**

(54) COMPOSITE SHOE SOLE, FOOTWEAR CONSTITUTED THEREOF AND METHOD PRODUCING THE SAME

(71) Applicant: W. L. Gore & Associates GmbH, Putzbrunn (DE)

(72) Inventors: Marc Peikert, Wolfratshausen (DE); Stane Nabernik, Kranj (SI)

(73) Assignee: W. L. Gore & Associates GmbH, Putzbrunn (DE)

( * ) Notice: Subject to any disclaimer, the term of this patent is extended or adjusted under 35 U.S.C. 154(b) by 77 days.

This patent is subject to a terminal disclaimer.

(21) Appl. No.: 14/543,997

(22) Filed: Nov. 18, 2014

(65) Prior Publication Data

US 2015/0082669 A1 Mar. 26, 2015

Related U.S. Application Data

(60) Continuation of application No. 13/693,316, filed on Dec. 4, 2012, now Pat. No. 9,351,534, which is a (Continued)

(30) Foreign Application Priority Data

Mar. 3, 2006 (DE) ..... 10 2006 010 007

(51) Int. Cl.
*A43B 7/12* (2006.01)
*A43B 13/12* (2006.01)
(Continued)

(52) U.S. Cl.
CPC ..... *A43B 7/125* (2013.01); *A43B 7/08* (2013.01); *A43B 7/12* (2013.01); *A43B 9/12* (2013.01);
(Continued)

(58) Field of Classification Search
CPC .... A43B 7/06; A43B 7/08; A43B 7/12; A43B 7/125; A43B 13/00; A43B 13/02; A43B 13/023; A43B 13/026; A43B 13/12
(Continued)

(56) References Cited

U.S. PATENT DOCUMENTS 1,974,456 A 9/1934 Goldzwcig
2,884,716 A 5/1959 Shelare et al.
(Continued)

FOREIGN PATENT DOCUMENTS

DE 1922089 4/1969
DE 2249138 4/1974
(Continued)

OTHER PUBLICATIONS

Decision to Grant for Ukraine Patent Application No. A 2013 06027 mailed Sep. 24, 2015.

*Primary Examiner* — Marie Bays
(74) *Attorney, Agent, or Firm* — Kilpatrick Townsend & Stockton, LLP

(57) ABSTRACT

A water-vapor permeable shoe-sole combination (15) with an upper side (5) having at least on through hole (31) extending through the thickness of the shoe-sole combination, a barrier unit (35) with an upper side forming at least part of the upper side (50) of the shoe-sole combination, made of a water-vapor permeable barrier material (33) that forms a barrier against penetration of foreign bodies, by means of which the at least one through hole (31) is closed in a water-vapor permeable manner, a reinforcement device (25) formed for mechanical reinforcement of the shoe-sole combination (105), constructed with at least one reinforcement web (37) arranged on at least one surface of the barrier material (33) and at least partially crossing the at least one
(Continued)

through hole (31), and at least one walking-sole part (117) arranged beneath the barrier unit (35).

50 Claims, 19 Drawing Sheets

Related U.S. Application Data division of application No. 12/281,527, filed as application No. PCT/EP2007/001821 on Mar. 2, 2007, now abandoned.

(51) Int. Cl.
*A43B 7/08* (2006.01)
*A43B 9/12* (2006.01)
*A43B 9/16* (2006.01)
*A43B 13/14* (2006.01)

(52) U.S. Cl.
CPC ..... *A43B 9/16* (2013.01); *A43B 13/12* (2013.01); *A43B 13/14* (2013.01)

(58) Field of Classification Search
USPC ..... 36/3 R, 3 A, 3 B, 114, 8.1, 25 R, 30 R
See application file for complete search history.

(56) References Cited

U.S. PATENT DOCUMENTS

| | | | | |
|---|---|---|---|---|
| 3,383,782 | A | 5/1968 | McGinnity | |
| 4,507,880 | A * | 4/1985 | Ohashi | A43B 5/0486 36/115 |
| 4,599,810 | A * | 7/1986 | Sacre | A43B 7/125 36/55 |
| 4,939,851 | A | 7/1990 | Miller | |
| 5,044,096 | A | 9/1991 | Polegato | |
| 5,733,826 | A | 3/1998 | Groitzsch | |
| 5,779,847 | A * | 7/1998 | Groeger | B01D 39/083 156/308.2 |
| 5,983,524 | A | 11/1999 | Polegato | |
| 6,014,821 | A | 1/2000 | Yaw | |
| 6,389,711 | B1 | 5/2002 | Polegato | |
| 6,508,015 | B1 | 1/2003 | Rauch | |
| 6,655,048 | B2 | 12/2003 | Moretti | |
| 6,874,251 | B2 | 4/2005 | Moretti | |
| 7,328,524 | B2 | 2/2008 | Lebo | |
| 7,367,141 | B2 | 5/2008 | Polegato Moretti | |
| 7,716,851 | B2 | 5/2010 | Polegato Moretti | |
| 9,351,534 | B2 * | 5/2016 | Peikert | A43B 7/125 |
| 2005/0126036 | A1 | 6/2005 | Wu | |
| 2005/0172513 | A1 | 8/2005 | Lechhart et al. | |
| 2005/0229431 | A1 | 10/2005 | Gerlin | |
| 2006/0162183 | A1 | 7/2006 | Moretti | |
| 2007/0271815 | A1 | 11/2007 | Moretti et al. | |
| 2009/0172971 | A1 * | 7/2009 | Peikert | A43B 7/125 36/88 |
| 2009/0193690 | A1 | 8/2009 | Moretti | |
| 2009/0211119 | A1 | 8/2009 | Moretti | |
| 2009/0277047 | A1 | 11/2009 | Polegato Moretti | |
| 2009/0300942 | A1 * | 12/2009 | Peikert | A43B 1/0045 36/88 |
| 2010/0011624 | A1 | 1/2010 | Polegato Moretti | |
| 2011/0167678 | A1 * | 7/2011 | Peikert | A43B 1/0027 36/3 R |
| 2012/0311892 | A1 * | 12/2012 | Peikert | A43B 7/125 36/30 R |
| 2013/0059116 | A1 * | 3/2013 | Peikert | A43B 7/125 428/138 |
| 2013/0247414 | A1 * | 9/2013 | Bier | A43B 7/08 36/45 |

FOREIGN PATENT DOCUMENTS

| | | |
|---|---|---|
| EP | 1506723 | 2/2005 |
| JP | S59-220361 | 12/1984 |
| JP | H7116002 | 5/1995 |
| JP | H11513582 | 11/1999 |
| JP | 2000/166606 | 6/2000 |
| JP | 2001/275713 | 10/2001 |
| JP | 2002-54201 | 12/2002 |
| JP | 2006-500128 | 1/2006 |
| JP | 2008/508004 | 3/2008 |
| KR | 10-2002-0026185 | 4/2002 |
| RU | 2254793 | 6/2005 |
| WO | WO2004/028284 | 4/2004 |
| WO | WO2005/063069 | 7/2005 |
| WO | WO2005/065479 | 7/2005 |
| WO | WO2006/010578 | 2/2006 |
| WO | WO2007/147421 | 12/2007 |

* cited by examiner

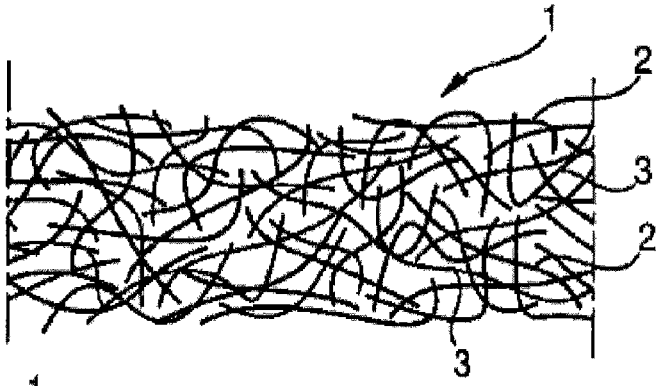
Fig. 1
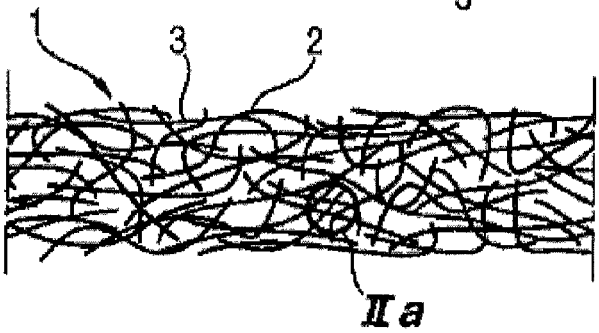
Fig. 2
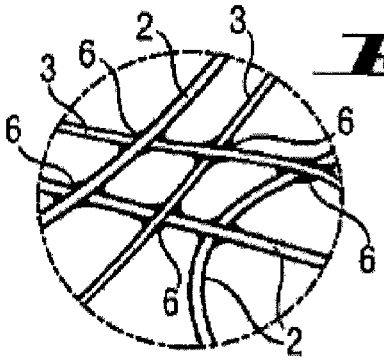
Fig. 2a
Fig. 2b
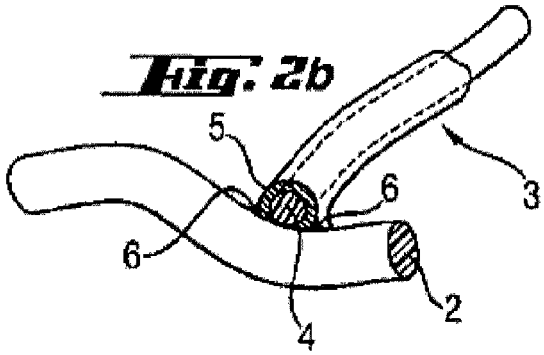
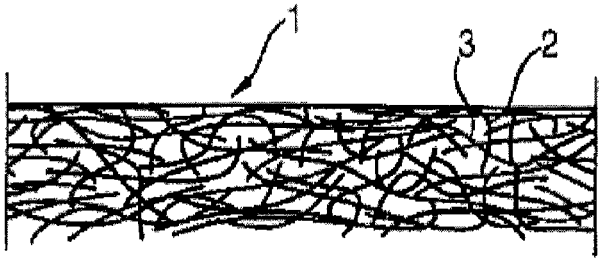
Fig. 3

COMPOSITE SHOE SOLE, FOOTWEAR CONSTITUTED THEREOF AND METHOD PRODUCING THE SAME

The invention relates to a composite shoe sole, footwear constructed with it, as well as a method for producing such footwear.

The need to decide, as an alternative, either on a waterproof shoe-bottom structure that blocks sweat moisture or on one permeable to sweat moisture, but also water-permeable, no longer exists, since there have been shoe-bottom structures that are waterproof, despite water-vapor-permeability, specifically based on the use of a perforated outsole or one provided with trough holes and a waterproof, water-vapor-permeable functional layer arranged above it, for example, in the form of a membrane. Documents EP 0,275,644 A2, EP 0,382,904 A2, EP 1,506, 723 A2, EP 0,858,270 B1, DE 100 36 100 C1, EP 959,704 B1, WO 2004/028,284 A1, DE 20 2004 08539 U1, and WO 2005/065,479 A1 provide examples.

Since the human foot has a strong tendency to sweat, the present invention seeks to make footwear available that has a shoe-bottom structure with particularly high water-vapor-permeability, without seriously compromising its stability.

In footwear with an outsole with small trough holes according to EP 0,382,904 A2, sufficient stability of the sole structure can be achieved with normally stiff outsole material, but only with moderate water-vapor-permeability of the shoe bottom.

Sole structures according to EP 959,704 B1 and WO 2004/028,284 A1, which have an outsole favoring higher water-vapor-permeability consisting essentially of only a peripheral frame for incorporation of water-vapor-permeable material in addition to a number of separate outsole cleats, which are supposed to protect a membrane situated above them from penetration of foreign bodies, such as small pebbles, but themselves are not separately stable, do not provide a degree of stabilization of the sole structure, as is desired for many types of footwear. The outsole in WO 2004/028,284 A1 is formed from the peripheral frame and a number of outsole cleats, which are distributed over the bottom of the sole within the peripheral frame.

The situation is similar in the sole structures according to DE 20 2004 08539 U1 and WO 2005/065479 A1, in which waterproof, water-vapor-permeable inserts are inserted into large-area openings of the outsole, which have a membrane that covers the opening in a waterproof manner and beneath it a laminated mesh serving as protection of the membrane against penetration of foreign objects. Since both the membrane and the laminated mesh consist of relatively soft material, so that they can scarcely make a contribution to stabilization of the sole structure, the stability of the sole structure is weakened at the sites of the large-area openings.

Better stabilization of the shoe-bottom structure was achieved in an athletic shoe according to DE 100 36 100 C1, whose outsole is formed from outsole parts with large-area openings, in that the outsole parts are arranged on the bottom of a support layer, consisting of compression-proof plastic, which is provided with mesh-like openings at the sites that lie above the large-area openings of the outsole parts and is therefore water-vapor-permeable, like the outsole parts. A membrane is arranged between a support layer and an insole situated above it, which is provided with holes for water-vapor-permeability, with which not only is waterproofness with water-vapor-permeability to be achieved, but it is also supposed to prevent small pebbles that the mesh openings of the support layer cannot keep out from penetrating into the interior of the shoe. The membrane, which is easily damaged by mechanical effects, is therefore supposed to offer protection, which it itself actually requires.

Other solutions, for example, according to EP 1,506,723 A2 and EP 0,858,270 B1, propose a protective layer beneath the membrane as protection against the penetration of foreign objects, such as pebbles that have entered through a perforated outsole.

In embodiments of EP 1,506,723 A2, the membrane and the protective layer are joined to each other by spot gluing, i.e., by means of a glue pattern applied as a dot matrix. Only the surface part of the membrane not covered by glue is still available for water-vapor transport. The membrane and the protective layer then form a glue composite that either forms a composite sole with an outsole that is attached as such to the shaft bottom of the footwear or forms a part of the shaft bottom, onto which an outsole still has to be attached.

In another embodiment of EP 1,506,723 A2, the outsole is divided in two in terms of thickness, both outsole layers are provided with flush trough holes of relatively small diameter, and the protective layer is arranged between the two outsole layers. The membrane in the finished footwear is situated on the top of the outsole. Since only the trough hole-surface part of this outsole is available for water-vapor passage, only a correspondingly smaller part of the membrane surface can have an effect on water-vapor passage. It has also turned out that standing air volumes inhibit water-vapor transport. Such standing air volumes are formed in the trough holes of this outsole, and their elimination by air circulation through the outsole is adversely affected by the protective layer. Added to the effect that the surface parts of the membrane that lie outside the trough holes of the outsole and makeup a significant percentage of the total membrane surface cannot have an effect on water-vapor transport is the fact that the surface parts of the membrane opposite the trough holes also have only a restricted effect on water-vapor transport.

It is now a common division of labor in the production of footwear that one manufacturer produces the shoe shaft and another manufacturer is responsible for producing the corresponding shoe sole or the corresponding composite shoe sole or molding it onto the shoe shaft. Since the manufacturers of shoe soles are ordinarily less equipped and experienced in handling waterproof, water-vapor-permeable membranes, shoe-bottom concepts are worth seeking, in which the composite shoe sole, as such, has no membrane and the membrane forms part of the shaft bottom, onto which the composite shoe sole is arranged.

It is therefore the task of the present invention to provide footwear that has a shoe-bottom structure with permanent waterproofness and with particularly high water-vapor permeability, preferably achieving the highest possible stability of the shoe-bottom structure, a composite shoe sole suitable for this, as well as a method for producing footwear.

To solve this task, the invention makes available a water-vapor-permeable composite shoe sole, footwear, and a method for producing footwear. Modifications of these objects are mentioned in the corresponding dependent claims.

According to a first aspect of the invention, a water-vapor-permeable composite shoe sole with a top is made available that has at least one opening extending through the thickness of the composite shoe sole. A barrier unit is provided with a top at least partially forming the top of the composite shoe sole, and with a water-vapor-permeable barrier material formed as a barrier against the penetration of foreign objects, by means of which the at least one opening is closed in a water-vapor-permeable manner. A stabilization device is assigned to the barrier material for mechanical stabilization of the composite shoe sole, which is constructed with at least one stabilization bar is arranged on at least one surface of the barrier material and at least partially bridges at least one opening.

At least one outsole part is arranged beneath the barrier unit. "Beneath the barrier unit" means that the at least one outsole part is arranged on the surface of the barrier unit facing the floor or ground. A situation is therefore achieved in which only the at least one outsole part assumes the function of walking or standing of the composite sole. The at least one outsole part is arranged on the barrier unit, so that no outsole parts are found in the at least one opening. Since the barrier unit does not represent or does not significantly represent the layer in the composite shoe sole that touches the ground, it is possible to optimize it with respect to its stabilizing properties, such as stiffness and torsion stiffness. In comparison with this, the outsole can be optimized with respect to its outsole function, for example, a material with limited wear and high adhesion can be chosen.

In one embodiment of the invention, the barrier material is a fiber composite with at least two fiber components that differ with respect to melting point. At least one part of a first fiber component then has a first melting point and a first softening temperature range lying beneath it and at least one part of a second fiber component has a second melting point and a second softening temperature range lying beneath it. The first melting point and the first softening temperature range are higher than the second melting point and the second softening temperature range. The fiber composite is thermally bonded, while maintaining water-vapor permeability in the thermally bonded area, as a result of thermal activation of the second fiber component with an adhesive softening temperature lying in the second softening temperature range.

"Melting point" is understood to mean, in the field of polymer or fiber structures, a narrow temperature range in which the crystalline areas of the polymer or fiber structure melt and the polymer converts to a liquid state. It lies above the softening temperature range and is a significant characteristic for partially crystalline polymers. "Softening temperature range" is understood to mean, in the field of synthetic fibers, a temperature range of different width occurring before the melting point is reached, in which softening, but no melting occurs.

This property is exploited in the barrier material to the extent that for both fiber components of the fiber composite, a material choice is made, so that the conditions according to the invention with respect to melting points and softening temperature ranges are satisfied for both fiber components, and a temperature is chosen for the thermal bonding that represents an adhesive softening temperature for the second fiber component, at which softening of the second fiber component occurs, in which case, its material exerts a gluing effect, so that at least part of the fibers of the second fiber component are thermally bonded to each other by gluing, so that bonding stabilization of the fiber composite occurs that is above the bonding obtained in a fiber composite with the same materials for the two fiber components by purely mechanical bonding, for example, by needle attachment of the fiber composite. The adhesive softening temperature can also be chosen in such a way that softening of the fibers of the second fiber component occurs to an extent that not only are the fibers of the second fiber component glued to each other, but also partial or complete enclosure of individual sites of the fibers of the first fiber composite with softened material of fibers of the second fiber composite occurs, i.e., partial or full embedding of such sites of fibers of the first fiber composite in the material of fibers of the second fiber composite, so that a correspondingly increased stabilization bonding of the fiber composite occurs.

In one embodiment of the composite shoe sole according to the invention, the barrier material has a fiber composite with a first fiber component and a second fiber component with two fiber parts, whereby the first fiber component has a first melting point and a softening temperature range lying beneath it, and a second fiber part of the second fiber component has a second melting point and a second softening temperature range lying beneath it; the first melting point and the first melting-point range are higher than the second melting point and the second softening temperature range, the first fiber part of the second fiber component has a higher melting point and a higher softening temperature lying beneath it than the second fiber part, and the fiber composite, as a result of thermal activation of the second fiber part of the second fiber component, is thermally bonded, while retaining water-vapor-permeability in the thermally bonded area, with an adhesive softening temperature lying in the second softening temperature range. A material choice is then made so that the conditions according to the invention with respect to melting points and softening temperature ranges for the two fiber components and fiber parts are satisfied and a temperature is chosen for thermal bonding that represents an adhesive softening temperature for the second fiber part or the second fiber component at which softening of this fiber part or the second fiber component occurs, in which case its material exerts an adhesive effect, so that at least part of the fibers of the second fiber component are thermally bonded to each other by gluing, so that bonding stabilization of the fiber composite occurs that is above the bonding obtained in a fiber composite with the same materials for both fiber components by purely mechanical bonding, for example, by needle attachment of the fiber composite.

A embodiment for the second fiber component with two fiber parts of different melting points or different softening temperature ranges has fibers with a core-shell structure in which the core has a higher melting point and a higher softening temperature range than the shell and thermal bonding of the fiber component occurs by appropriate softening of the shell.

Another embodiment for the second fiber component with two fiber parts of different melting point or different softening temperature ranges has fibers with a side-to-side structure, in which the second fiber component has two fiber parts running parallel to each other in the longitudinal direction of the fibers, a first one of which has a higher melting point and a higher softening temperature range than the second fiber part, and thermal attachment of the fiber composite occurs by appropriate softening of the second fiber part.

In this embodiment, the adhesive softening temperature can also be chosen in such a way that softening of the second fiber part of the second fiber component occurs to such an extent that not only are the second fiber parts of the second fiber component bonded to each other, but additionally partial or full enclosure of individual sites of the fibers of the first fiber component with softened material of the second fiber part of the second fiber component, i.e., partial or full embedding of those sites of fibers of the first fiber component in material of the second fiber part of the second fiber component, occurs, so that a correspondingly increased stabilization bonding of the fiber composite develops. This is especially true for the case in which the second fiber component has the already mentioned side-to-side fiber structure. During adhesive softening of the second fiber part of the second fiber component to the mentioned extent, partial or full enclosure, not only of individual sites of fibers of the first fiber component, but also of the first fiber part of the second fiber component, can then occur.

By additional compression of the fiber composite during or after adhesive softening of the second fiber component, an additional increase in stabilization can be achieved, in which partial or full embedding of fiber sites in softened material of fibers of the second fiber component is further intensified. The thermal bonding of the fiber composite, achieved by using the adhesive softening temperature, is to be chosen, on the other hand, in such a way that sufficient water-vapor permeability of the fiber composite is produced, i.e., fiber bonding is always restricted to the individual bonding sites, so that sufficient unbonded sites for water-vapor transport remain. The choice of adhesive softening temperature can be made according to the desired requirements of the practical embodiment, especially with respect to stability properties and water-vapor permeability.

By selecting specific materials for the two fiber components and by selecting the degree of thermal bonding of the fiber composite, a desired stabilization of the fiber composite with respect to its state before thermal bonding can be achieved while maintaining water-vapor permeability. Because of this thermal bonding, the fiber composite reaches a strength, based on which it is particularly suitable as a water-vapor-permeable barrier material that stabilizes a composite shoe sole and is therefore suitable for footwear whose shoe bottom is supposed to have good water-vapor-permeability, on the one hand, and good stability, on the other.

Because of its thermal bonding and the achieved stability, such a barrier material is particularly suited for a composite shoe sole that is designed to obtain high water-vapor permeability with large-area openings, so that it requires, on the one hand, a barrier material for protection of a membrane situated above it from penetration of foreign objects, such as pebbles, through such an opening to the membrane and, on the other hand, additional stabilization, because of the large-area openings.

Unlike a non-woven fiber composite traditionally used in the shoe-bottom area, which is constructed with a single fiber component that is completely melted and thermally compressed in the attempt at thermal bonding, in such a barrier material, by selecting the materials for the at least two fiber components and by the parameters chosen for thermal bonding, degrees of freedom can be utilized by means of which the degree of the desired stability, as well as the degree of water-vapor permeability, can be set. By softening the fiber component with the lower melting point, not only are the fibers of this fiber component fixed with respect to each other, but during the thermal bonding process, fixation of the fiber of the other fiber component with the higher melting point also occurs, which leads to particularly good mechanical bonding and stability of the fiber composite. By choosing the ratio between fibers of the fiber component with higher melting point and the fibers of the fiber component with the lower melting point, as well as by choosing the adhesive softening temperature and therefore the degree of softening, properties of the barrier material, such as air permeability, water-vapor permeability, and mechanical stability of the barrier material, can be adjusted.

In one embodiment of the barrier material, its fiber composite is a textile fabric, which can be a woven, warp-knit, knit, non-woven fabric, felt, mesh, or lay. In one practical embodiment, the fiber composite is a mechanically strengthened non-woven fabric, whereby mechanical bonding can be achieved by needling the fiber composite. Water-jet bonding can also be used for mechanical bonding of the fiber composite, in which, instead of true needles, water jets are used for mechanically bonding entanglement of the fibers of the fiber composite.

In one embodiment of the invention, the first fiber component is a support component and the second fiber component is a bonding component of the barrier material.

In one embodiment of the invention, in which the second fiber component has a first fiber part having a higher melting point and a second fiber part having a lower melting point, the first fiber part of the second fiber component forms an additional support component in addition to the first fiber component, the second fiber part of the second fiber component forming the bonding component of the barrier material.

The choice of materials for the fiber components is made in one embodiment in such a way that at least part of the second fiber component and then, if the second fiber component includes at least a first fiber part and a second fiber part, at least part of the second fiber part of the second fiber component can be activated at a temperature in the range between 80° C. and 230° C. for adhesive softening.

In one embodiment, the second softening temperature range lies between 60° C. and 220° C.

Especially in view of the fact that footwear and especially its sole structure are often exposed to relatively high temperatures during production, for example, when an outsole is molded on, in one embodiment of the invention, the first fiber component, and optionally the first fiber part of the second fiber component, are melt-resistant at a temperature of at least 130° C., whereby, in practical embodiments, melt resistance at a temperature of at least 170° C. or even at least 250° C. is chosen by corresponding selection of the material for the first fiber part, and optionally for the first fiber part of the second fiber component.

For the first fiber part, and optionally the first fiber part and the second fiber component, materials such as natural fibers, plastic fibers, metal fibers, glass fibers, carbon fibers, and blends thereof, are appropriate. Leather fibers represent an appropriate material in the context of natural fibers.

In one embodiment of the invention, the second fiber component, and optionally the second fiber part of the second fiber component, are constructed with at least one synthetic fiber suitable for thermal bonding at an appropriate temperature.

In one embodiment of the invention, at least one of the two fiber components, and optionally at least one of the two fiber parts of the second fiber component, are chosen from the material group including polyolefins, polyamide, copolyamide, viscose, polyurethane, polyacrylic, polybutylene terephthalate, and blends thereof. The polyolefin can then be chosen from polyethylene and polypropylene.

In one embodiment of the invention, the first fiber component, and optionally the first fiber part of the second fiber component, is chosen from the material group polyesters and copolyesters.

In one embodiment of the invention, at least the second fiber component, and optionally at least the second fiber part of the second fiber component, are constructed with at least one thermoplastic material. The second fiber component, and optionally the second fiber part of the second fiber component, can be chosen from the material group polyamide, copolyamide, and polybutylene terephthalate and polyolefins, or also from the material group polyester and copolyester.

Examples of appropriate thermoplastic materials are polyethylene, polyamide (PA), polyester (PET), polyethylene (PE), polypropylene (PP), and polyvinylchloride (PVC). Additional appropriate materials are rubber, thermoplastic rubber (TR), and polyurethane (PU). Thermoplastic polyurethane (TPU), whose parameters (hardness, color, elasticity, etc.) can be adjusted very variably, is also suitable.

In one embodiment of the invention, both fiber parts of the second fiber component consist of polyester, the polyester of the second fiber part having a lower melting point than the polyester of the first fiber part.

In one embodiment of the invention, at least the second fiber component has a core-shell structure, i.e., a structure, in which a core material of the fiber component is coaxially surrounded by a shell layer. The first fiber part, having a higher melting point, then forms the core, and the second fiber part, having a lower melting point, forms the shell.

In another embodiment of the invention, at least the second fiber component has a side-to-side structure, i.e., two fiber parts of different material running next to each other in the longitudinal direction of the fiber, each of which have a semicircular cross-section, for example, are placed against each other, so that the two fiber components are joined to each other side by side. One side then forms the first fiber part of the barrier material, having a higher melting point, and the second side forms the second fiber part of the second fiber component of the barrier material, having a lower melting point.

In one embodiment of the invention, the second fiber component has a weight percentage, referred to the basis weight of the fiber composite in the range from 10% to 90%. In one embodiment, the weight percentage of the second fiber component lies in the range from 10% to 60%. In practical embodiments, the weight percentage of the second fiber component is 50% or 20%.

In one embodiment of the invention, the materials for the two fiber components, and optionally for the two fiber parts of the second fiber component, are chosen in such a way that their melting points differ by at least 20 C.°.

The barrier material can be thermally bonded over its entire thickness. Depending on the requirements to be achieved, especially with respect to air permeability, water-vapor permeability, and stability, an embodiment can be chosen in which only part of the thickness of the barrier material is thermally bonded. In one embodiment of the invention, the barrier material thermally bonded over at least part of its thickness is additionally compressed on at least one surface by means of pressure and temperature. It can be advantageous to smooth the bottom of the barrier material facing the tread of the composite shoe sole by surface compression, because dirt that reaches the bottom of the barrier material through openings of the composite shoe sole then adheres less readily to it. At the same time, the abrasion resistance of the barrier material is increased.

In one embodiment of the invention, the barrier material is finished or treated with one or more agents from the material group water repellants, dirt repellants, oil repellants, anti-bacterial agents, deodorants, and/or a combination thereof.

In another embodiment, the barrier material is treated so as to be water-repellant, dirt-repellant, oil-repellant, antibacterial and/or treated against odor.

In one embodiment of the invention, the barrier material has a water-vapor permeability of at least 4000 g/m$^2$-24 h. In practical embodiments, a water-vapor permeability of at least 7000 g/m$^2$-24 h or even 10,000 g/m$^2$-24 h is chosen.

In one embodiment of the invention, the barrier material is designed to be water-permeable.

In embodiments of the invention, the barrier material has a thickness in the range from at least 1 mm to 5 mm, whereby practical embodiments, especially in the range from 1 mm to 2.5 mm, or even in the range from 1 mm to 1.5 mm, are chosen, the specially selected thickness depending on the special application of the barrier material, and also on which surface smoothness, air permeability, water-vapor permeability, and mechanical strength are to be provided.

In a practical embodiment of the invention, the barrier material has a fiber composite with at least two fiber components that differ with respect to melting point and softening temperature range, a first fiber component consisting of polyester and having a first melting point and a first softening temperature range lying beneath it, and at least part of a second fiber component having a second melting point and a second softening temperature range lying beneath it, whereby the first melting point and the first melting-point range are higher than the second melting point and the second melting-point range. The second fiber component has a core-shell structure and a first fiber part of polyester that forms the core and a second fiber part of polyester that forms the shell, the first fiber part having a higher melting point and a higher softening temperature range than the second fiber part. The fiber composite, as a result of thermal activation of the second fiber component, is thermally bonded, while maintaining water-vapor permeability in the thermally bonded area, with an adhesive softening temperature lying in the second softening temperature range, and the fiber composite is a needled nonwoven fabric that is compressed on at least one of its surfaces by means of pressure and temperature.

In one embodiment of the invention, the barrier material is obtained by surface compression of a surface of the fiber composite with a surface pressure in the range from 11.5 N/cm$^2$ to 4 N/cm$^2$ at a heating-plate temperature of 230° C. for 10 s. In a practical embodiment, the surface compression of a surface of the fiber composite occurs with a surface pressure of 3.3 N/cm$^2$ at a heating-plate temperature of 230° C. for 10 s.

In one embodiment of the invention, the barrier material is produced with a puncture strength in the range from 290 N to 320 N, so that it forms a good protection for a waterproof, water-vapor-permeable membrane situated above it against penetration of foreign objects, such as small pebbles.

Such a barrier material is therefore particularly suited in a water-vapor-permeable composite shoe sole as a water-vapor-permeable barrier layer that stabilizes the composite shoe sole and protects the membrane situated above it.

A barrier unit constructed with such a barrier material is therefore particularly suited for a composite shoe sole according to the invention.

According to the invention, at least one stabilization device for stabilizing the barrier material and therefore the composite shoe sole is assigned to the barrier material. This is advantageous, especially when the barrier material itself is not designed or not adequately designed as a stabilization material, so that the barrier material acquires stabilization or stabilization support from the stabilization device. In this case, a situation is achieved in which additional stabilization is added to the intrinsic stability that the barrier material has, because of its thermal bonding, and optionally surface compression, which can be produced deliberately at certain sites of the barrier unit, especially in the area of openings of the composite shoe sole, which are made with a large surface, in order to provide high water-vapor-permeability of the composite shoe sole.

The forefoot area and midfoot area of the composite shoe sole will be discussed next. In the human foot, the forefoot is the longitudinal foot area extending over the toes and ball of the foot to the beginning of the instep, and the midfoot is the longitudinal foot area between the ball of the foot and the heel. In connection with the composite shoe sole according to the invention, forefoot area and midfoot area mean the longitudinal areas of the composite shoe sole over which the forefoot or the midfoot of the wearer of the footwear extends when wearing footwear provided with such a composite shoe sole.

In one embodiment of the invention, the at least one stabilization device is designed in such a way that at least 15% of the surface of the forefoot area of the composite shoe sole is water-vapor-permeable.

In one embodiment of the invention, the at least one stabilization device is designed in such a way that 25% of the surface of the forefoot area of the composite shoe sole is water-vapor-permeable.

In one embodiment of the invention, the at least one stabilization device is designed in such a way that 40% of the surface of the forefoot area of the composite shoe sole is water-vapor-permeable.

In one embodiment of the invention, the at least one stabilization device is designed in such a way that 50% of the surface of the forefoot area of the composite shoe sole is water-vapor-permeable.

In one embodiment of the invention, the at least one stabilization device is designed in such a way that 60% of the surface of the forefoot area of the composite shoe sole is water-vapor-permeable.

In one embodiment of the invention, the at least one stabilization device is designed in such a way that 75% of the surface of the forefoot area of the composite shoe sole is water-vapor-permeable.

In one embodiment of the invention, the at least one stabilization device is designed in such a way that 15% of the surface of the midfoot area of the composite shoe sole is water-vapor-permeable.

In one embodiment of the invention, the at least one stabilization device is designed in such a way that 25% of the surface of the midfoot area of the composite shoe sole is water-vapor-permeable.

In one embodiment of the invention, the at least one stabilization device is designed in such a way that 40% of the surface of the midfoot area of the composite shoe sole is water-vapor-permeable.

In one embodiment of the invention, the at least one stabilization device is designed in such a way that 50% of the surface of the midfoot area of the composite shoe sole is water-vapor-permeable.

In one embodiment of the invention, the at least one stabilization device is designed in such a way that 60% of the surface of the midfoot area of the composite shoe sole is water-vapor-permeable.

In one embodiment of the invention, the at least one stabilization device is designed in such a way that 75% of the surface of the midfoot area of the composite shoe sole is water-vapor-permeable.

The stabilization devices of the midfoot area leading to the different percentages mentioned above can be combined with individual stabilization units of the forefoot area leading to the different percentages stated above.

In one embodiment of the invention, the at least one stabilization device is designed in such a way that at least 15% of the front half of the longitudinal extent of the composite shoe sole is water-vapor-permeable.

In one embodiment of the invention, the at least one stabilization device is designed in such a way that at least 25% of the front half of the longitudinal extent of the composite shoe sole is water-vapor-permeable.

In one embodiment of the invention, the at least one stabilization device is designed in such as way that at least 40% of the front half of the longitudinal extent of the composite shoe sole is water-vapor-permeable.

In one embodiment of the invention, the at least one stabilization device is designed in such a way that at least 50% of the front half of the longitudinal extent of the composite shoe sole is water-vapor-permeable.

In one embodiment of the invention, the at least one stabilization device is designed in such a way that at least 60% of the front half of the longitudinal extent of the composite shoe sole is water-vapor-permeable.

In one embodiment of the invention, the at least one stabilization device is designed in such a way that at least 75% of the front-half of the longitudinal extent of the composite shoe sole is water-vapor-permeable.

In one embodiment of the invention, the at least one stabilization device is designed in such a way that of the longitudinal extent of the composite shoe sole minus the heel area, at least 15% is water-vapor-permeable.

In one embodiment of the invention, the at least one stabilization device is designed in such a way that of the longitudinal extent of the composite shoe sole minus the heel area, at least 25% is water-vapor-permeable.

In one embodiment of the invention, the at least one stabilization device is designed in such a way that of the longitudinal extent of the composite shoe sole minus the heel area, at least 40% is water-vapor-permeable.

In one embodiment of the invention, the at least one stabilization device is designed in such a way that of the longitudinal extent of the composite shoe sole minus the heel area, at least 50% is water-vapor-permeable.

In one embodiment of the invention, the at least one stabilization device is designed in such a way that of the longitudinal extent of the composite shoe sole minus the heel area, at least 60% is water-vapor-permeable.

In one embodiment of the invention, the at least one stabilization device is designed in such a way that of the longitudinal extent of the composite shoe sole minus the heel area, at least 75% is water-vapor-permeable.

The percentages just stated, in conjunction with water-vapor-permeability, refer to that part of the entire composite shoe sole that corresponds to the surface within the outside contour of the foot sole of the wearer of the footwear, i.e., essentially the surface part of the composite shoe sole that is enclosed in the finished footwear by the inner periphery of the lower shaft end on the sole side (shaft contour on the sole side). A shoe sole edge that protrudes radially outward above the shaft contour on the sole side, i.e., protrudes above the foot sole of the wearer of the footwear, need not have water-vapor permeability, because no sweat-releasing foot area is situated there. The percentages mentioned therefore refer, with respect to the forefoot area, to the part of the surface included by the shaft contour on the sole side bonded on the forefoot length and, with respect to the midfoot area, to the part of the surface enclosed by the shaft contour on the sole side bounded on the midfoot length.

If the footwear in question is a business shoe whose outsole has an outsole peripheral edge protruding relatively widely above the outside of the shaft contour on the sole side, which, for example, is firmly stitched on a mounting frame that also runs around the outside of the shaft contour on the sole side, water-vapor permeability need not exist in the area of this outsole peripheral edge, since this area is situated outside the part of the composite shoe sole contacted by the foot, and therefore no sweat release occurs in this area. The percentages mentioned in the preceding paragraphs refer to footwear that does not have the above-mentioned protruding outsole edge typical of business shoes. Since this outsole area of the business shoe can account for about 20% of the total outsole surface, about 20% can be subtracted in business shoes from the total outsole surface, and the above-mentioned percentages for water-vapor permeability of the composite shoe sole pertain to the remaining 80% of the total outsole surface.

The stabilization device can consist of one or more stabilization bars, which are arranged, for example, on the bottom of the barrier material on the outsole side. In one embodiment, the stabilization device is provided with at least one opening, which forms at least one part of the trough hole after production of the composite shoe sole and is closed with barrier material.

In one embodiment of the invention, the above-mentioned percentage water-vapor permeabilities in the forefoot area and/or midfoot area are provided mostly or even exclusively in the area of the at least one opening of the stabilization device.

In one embodiment of the invention, at least one support element is assigned to the barrier material in the trough hole or at least one of the trough holes, which extends from the side of the barrier material facing the tread to the level of the tread, so that the barrier material, during walking, is supported on the floor by the support element. In this case, at least one of the stabilization bars can simultaneously be designed as a support element.

In the composite shoe sole, which, according to the invention, has the barrier unit and a one-part or multipart outsole arranged beneath it, which has passage openings for water-vapor permeability, the passage openings of the outsole or outsole parts and the barrier unit can have the same or different surface areas. It is important that these passage openings overlap at least partially, whereby an intersection surface of the corresponding passage opening of the barrier unit and the corresponding passage opening of the outsole or the outsole part forms an opening through the entire composite shoe sole. When a specific dimension of the corresponding passage opening of the outsole or outsole part is stipulated, the extent of the opening is greatest when the corresponding passage opening of the barrier unit is at least equally large and extends over the entire area of the corresponding passage opening of the outsole or outsole part, or vice versa.

It is proposed that the stabilization device, with the at least one stabilization bar, not be a component of the at least one outsole part. This means that the stabilization device, and especially the at least one stabilization bar, does not assume an outsole function. In particular, a stabilization device with the at least one stabilization bar has a spacing from the floor or substrate. The composite shoe sole with outsole is prescribed for walking and standing on a floor or on the ground. In this case, the at least one stabilization bar in the composite shoe sole is situated above the floor or ground and a certain distance is prescribed between the stabilization bar and the floor. In one embodiment, the distance corresponds to the thickness of the at least one outsole part, which is arranged beneath the barrier unit.

An exception from the stipulation that the at least one stabilization bar has a spacing from the floor or the ground applies when a stabilization bar is simultaneously formed as a support element that extends to the floor or ground.

In another embodiment, it is prescribed that the outsole part has a first material and the stabilization device has a second material that is different from the first material, the second material being harder (according to Shore) than the first material. "Hardness" is understood to mean the mechanical resistance that a substance has in order to withstand the penetration of another, harder substance.

Due to the fact that the corresponding opening of the composite shoe sole is closed with a water-vapor-permeable barrier material, water-vapor permeability in the at least one opening of the composite shoe sole is achieved with simultaneous protection of a membrane situated above it against the penetration of foreign objects, such as pebbles. If a barrier material is used for the barrier unit that can be equipped with a much higher intrinsic stability, as a result of thermal bonding and optionally additional surface compression, than the material can offer without thermal bonding and surface bonding, such a barrier material for the barrier unit can offer additional stabilization to the composite shoe sole provided with openings, even if the one or more openings of the composite shoe sole are designed with a very large area in the interest of high water-vapor-permeability. This intrinsic stability is further increased by the use of the already mentioned additional stabilization device and selectively in areas of the composite shoe sole that require special stabilization.

If the stabilization device is provided with several openings, these can either be closed overall with a piece of the barrier material or each with a piece of barrier material.

The stabilization device can be designed to be sole-shaped, if it is to extend over the entire area of the composite shoe sole, or partially sole-shaped, if it is to be provided only in part of the surface of the composite shoe sole.

In one embodiment of the invention, the stabilization device of the barrier unit has at least one stabilization frame that stabilizes at least the composite shoe sole, so that the composite shoe sole experiences an additional stabilization apart from the stabilizing effect through the barrier material. A particularly good stabilization effect is achieved if the stabilization frame is fit into the at least one opening, or at least one of the openings of the composite shoe sole, so that where the composite shoe sole is initially weakened in its stability by the openings with the largest possible area, good stabilization of the composite shoe sole is nevertheless ensured by means of the stabilization frame.

In one embodiment of the barrier unit according to the invention, the at least one opening of the stabilization device has an area of at least 1 $cm^2$. In practical embodiments, an opening surface with at least one opening of at least 5 $cm^2$, for example, in the range from 8 to 15 $cm^2$, or even at least 10 $cm^2$, or even at least 20 $cm^2$, or even at least 40 $cm^2$, is chosen.

In the barrier unit according to the invention, the stabilization device has at least one stabilization bar that is arranged on at least one surface of the barrier material and at least partially bridges the surface of the at least one opening. If the stabilization device is provided with a stabilization frame, a stabilization bar can be arranged on the stabilization frame. Several stabilization bars can be provided that form a mesh-like structure on at least one surface of the barrier material. Such a mesh structure leads to particularly good stabilization of the composite shoe sole, on the one hand, and also prevents larger foreign objects, such as larger stones or ground elevations, from penetrating up to the barrier material and being felt by the user of the footwear equipped with such a barrier unit.

In one embodiment, the stabilization device of the barrier unit of the composite shoe sole according to the invention is constructed with at least one thermoplastic material. Thermoplastic materials of the above-mentioned type can be used for this.

In one embodiment of the invention, the stabilization device and the barrier material are at least partially connected to each other, for example, by gluing, welding, molding on or around, or vulcanization on or around. During molding or vulcanization on, mostly attaching between the stabilization device and the barrier material occurs on opposite surface areas. During molding and vulcanization around, mostly peripheral incorporation of the barrier material with the stabilization device occurs.

In one embodiment, the composite shoe sole is water-permeable.

According to a second aspect, the invention makes available footwear with a composite shoe sole according to the invention that can be constructed according to one or more of the embodiments mentioned above in conjunction with the composite shoe sole. The footwear then has a shaft provided on a shaft-end area on the sole side with a waterproof and water-vapor-permeable shaft-bottom functional layer, whereby the composite shoe sole is connected to the shaft-end area provided with the shaft-bottom functional layer, so that the shaft-bottom functional layer, at least in the area of at least one opening of the composite shoe sole, is not joined to the barrier material.

The shaft-bottom functional layer in this footwear according to the invention, on the shaft-end area on the sole side and the barrier material in the composite shoe sole according to the invention, leads to several advantages. On the one hand, handling of the shaft-bottom functional layer is brought into the area of shaft production and kept out of the area of production of the composite shoe sole. This takes into account the practice that shaft manufacturers and composite-sole manufactures are often different manufacturers or at least different manufacturing areas, and the shaft manufacturer is usually better set up to handle the functional layer material and its intrinsic problems than shoe-sole manufacturers or composite-shoe-sole manufacturers. On the other hand, the shaft-bottom functional layer and the barrier material, if they are not accommodated in the composite itself, but are divided to the shaft-bottom composite and the shoe-sole composite, after attachment of the composite shoe sole to the lower shaft-end area, can be kept essentially unconnected to each other, since their positioning with respect to each other in the finished footwear is brought about by attachment (by gluing on or molding on) of the composite shoe sole onto the lower shaft end. Keeping the shaft-bottom functional layer and the attaching material fully or largely unbonded to each other means that there need be no gluing between them, which would lead to blocking of part of the active area of the functional layer with water-vapor permeability, even during gluing with a spot-like glue.

In one embodiment of the footwear according to the invention, the shaft is constructed with at least one shaft material that has a waterproof shaft functional layer, at least in the area of the shaft-end area on the sole side, whereby, between the shaft functional layer and the shaft-bottom functional layer, a waterproof seal exists. Footwear is then achieved in which the foot[wear] is waterproof, both in the shaft area and in the shaft-bottom area, and at the transition sites between the two, while maintaining water-vapor permeability both in the shaft and shaft-bottom area.

In one embodiment of the footwear according to the invention, the shaft-bottom functional layer is assigned to a water-vapor-permeable shaft-mounting sole, whereby the shaft-bottom functional layer can be part of a multilayer laminate. The shaft-mounting sole can itself also be formed by the shaft-bottom functional layer constructed with the laminate. The shaft-bottom functional layer, and optionally the shaft functional layer, can be formed by a waterproof, water-vapor-permeable coating or by a waterproof, water-vapor-permeable membrane, whereby either a microporous membrane or a membrane having no pores can be involved. In one embodiment of the invention, the membrane has expanded polytetrafluoroethylene (ePTFE).

Appropriate materials for the waterproof, water-vapor-permeable functional layer are polyurethane, polypropylene, and polyester, including polyether esters and laminates thereof, as described in documents U.S. Pat. No. 4,725,418 and U.S. Pat. No. 4,493,870. However, expanded microporous polytetrafluoroethylene (ePTFE) is particularly preferred, as described, for example, in documents U.S. Pat. No. 3,953,566 and U.S. Pat. No. 4,187,390, and expanded polytetrafluoroethylene provided with hydrophilic impregnation agents and/or hydrophilic layers; see, for example, document U.S. Pat. No. 4,194,041. "Microporous functional layer" is understood to mean a functional layer whose average pore size is between about 0.2 μm and about 0.3 μm. The pore size can be measured with the Coulter Porometer (trade name), which is produced by Coulter Electronics Inc., Hialeah, Fla., USA.

According to a third aspect, the invention makes available a method for producing footwear, which, in addition to a water-vapor-permeable composite shoe sole according to the invention, for example, according to one or more of the embodiments mentioned above for the composite shoe sole, has a shaft provided on a shaft-end area on the sole side with a waterproof and water-vapor-permeable shaft-bottom functional layer. In this method, the composite shoe sole and the shaft are prepared first. The shaft is provided on the shaft-end area on the sole side with a waterproof and water-vapor-permeable shaft-bottom functional layer. The composite shoe sole and the shaft end area provided on the sole side with the shaft-bottom functional layer are joined to each other, so that the shaft-bottom functional layer remains unconnected to the barrier material, at least in the area of the at least one opening. This leads to the advantages already explained above.

In one embodiment of this method, the shaft-end area on the sole side is closed with the shaft-bottom functional layer. For the case in which the shaft is provided with a shaft functional layer, a waterproof connection is produced between the shaft functional layer and the shaft-bottom functional layer. This leads to footwear that is waterproof and water-vapor-permeable footwear overall.

The invention, task aspects of the invention, and advantages of the invention will now be further explained with reference to embodiments. In the corresponding drawings:

FIG. 1 shows a sketch of a non-woven material, mechanically bonded by needling;

FIG. 2 also shows, a sketch of the non-woven material according to FIG. 1, after thermal bonding;

FIG. 2*a* shows a cutout, also as a sketch, at a highly enlarged scale of area IIa of the thermally bonded non-woven material of FIG. 2.

FIG. 2*b* shows a cutout, also in a sketch, with an even more enlarged scale of area IIa, shown in FIG. 2, of the thermally bonded non-woven material of FIG. 2.

FIG. 3 shows a sketch of the thermally bonded non-woven material depicted in FIG. 2 after additional thermal surface compression;

Figure 12:
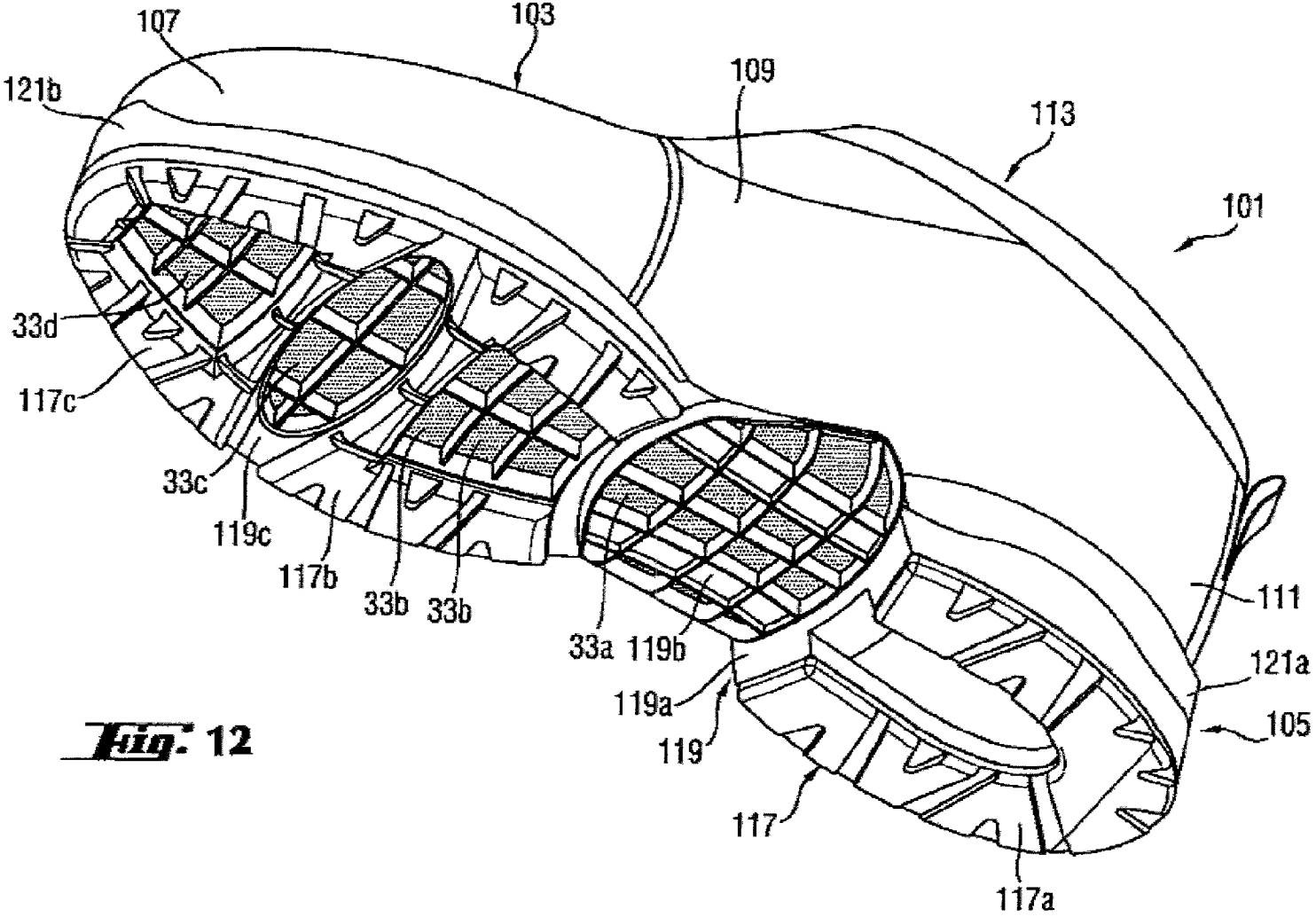
FIG. 12 shows a perspective oblique view from the bottom of a shoe provided with a composite sole according to the invention.
Figure 13A:
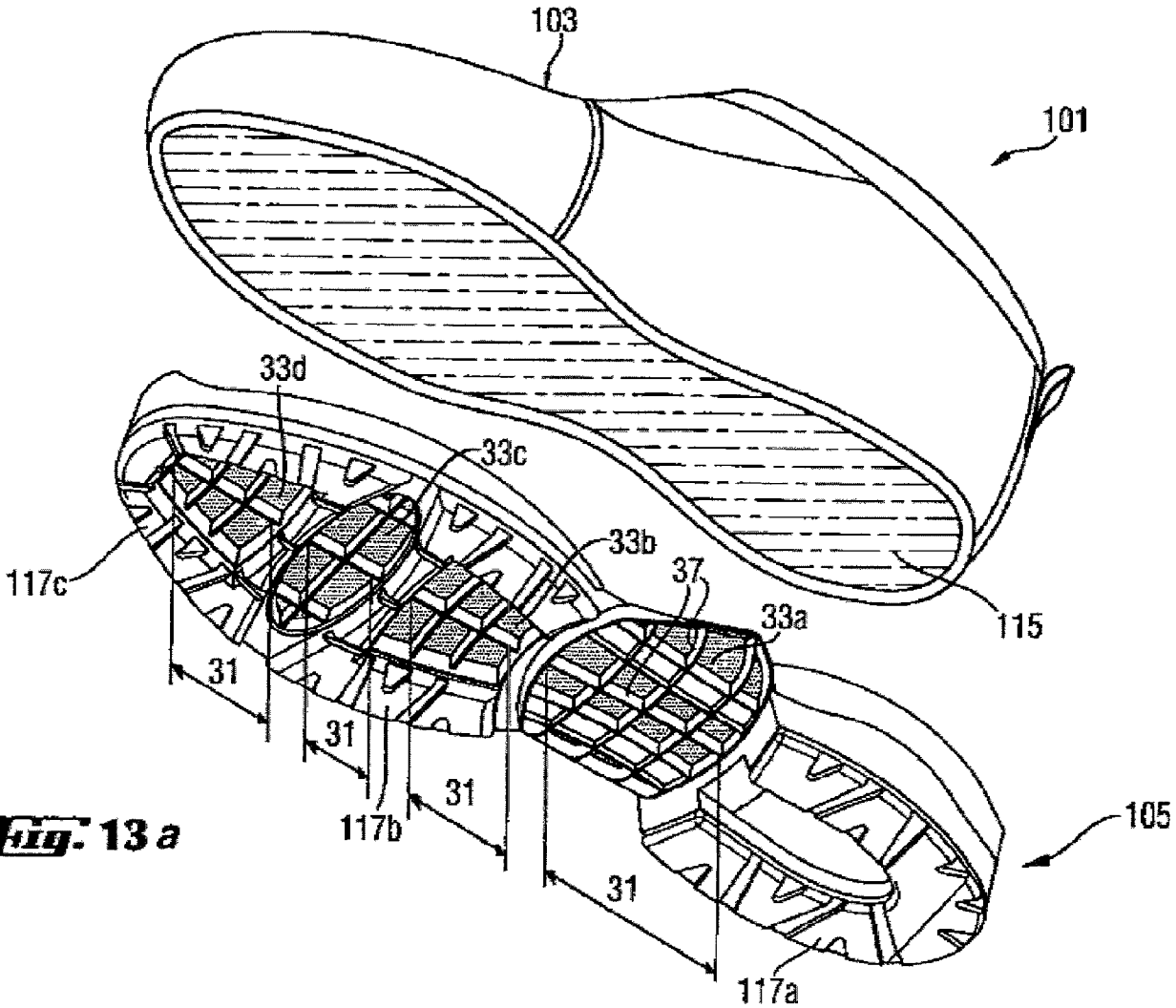

FIG. 13*a* shows the shoe depicted in FIG. 12, but before a composite shoe sole according to the invention is placed on a shaft bottom of the shoe.

Figure 13B:
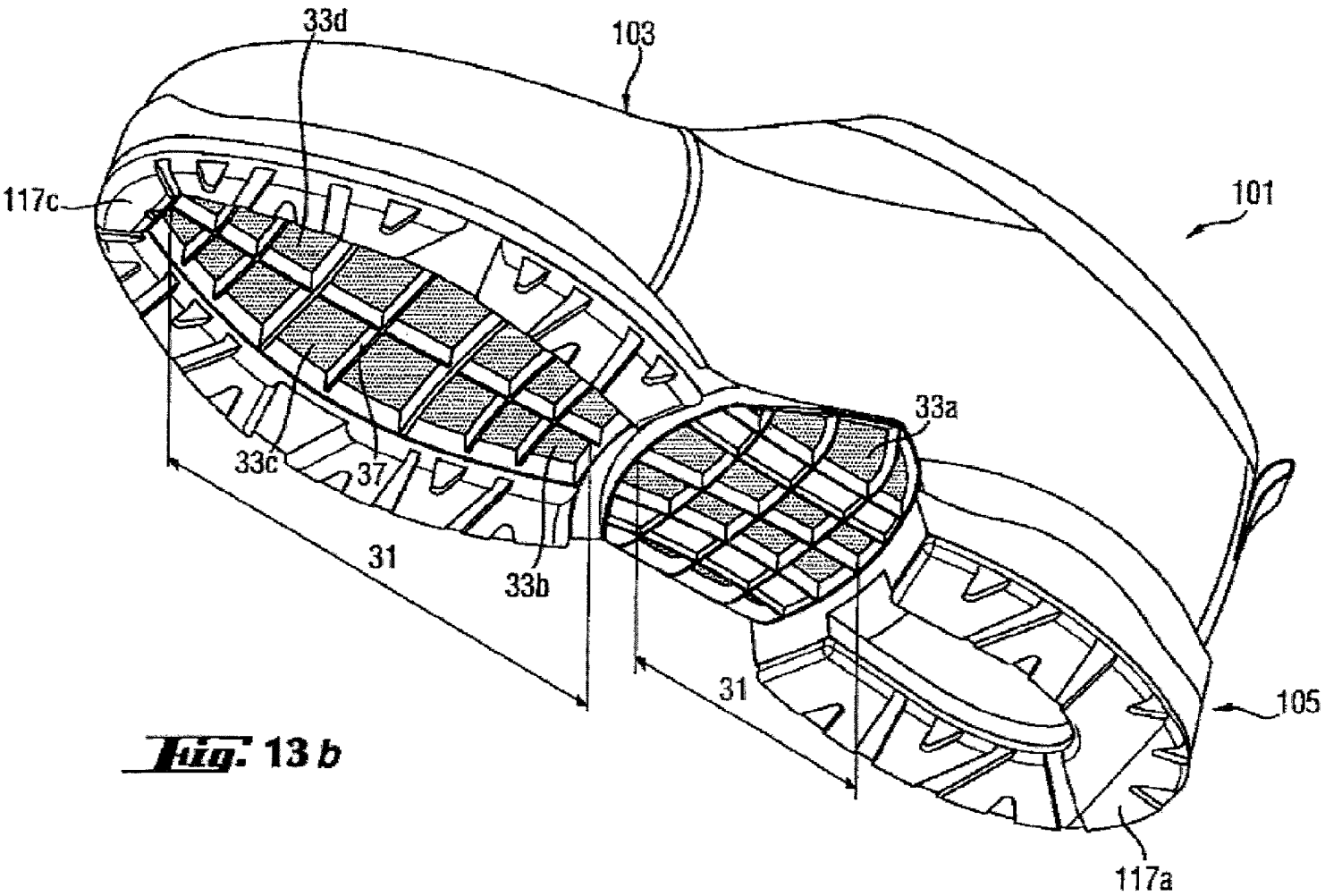

FIG. 13*b* shows the shoe depicted in FIG. 12, which is provided with another example of a composite sole according to the invention.

Figure 14:
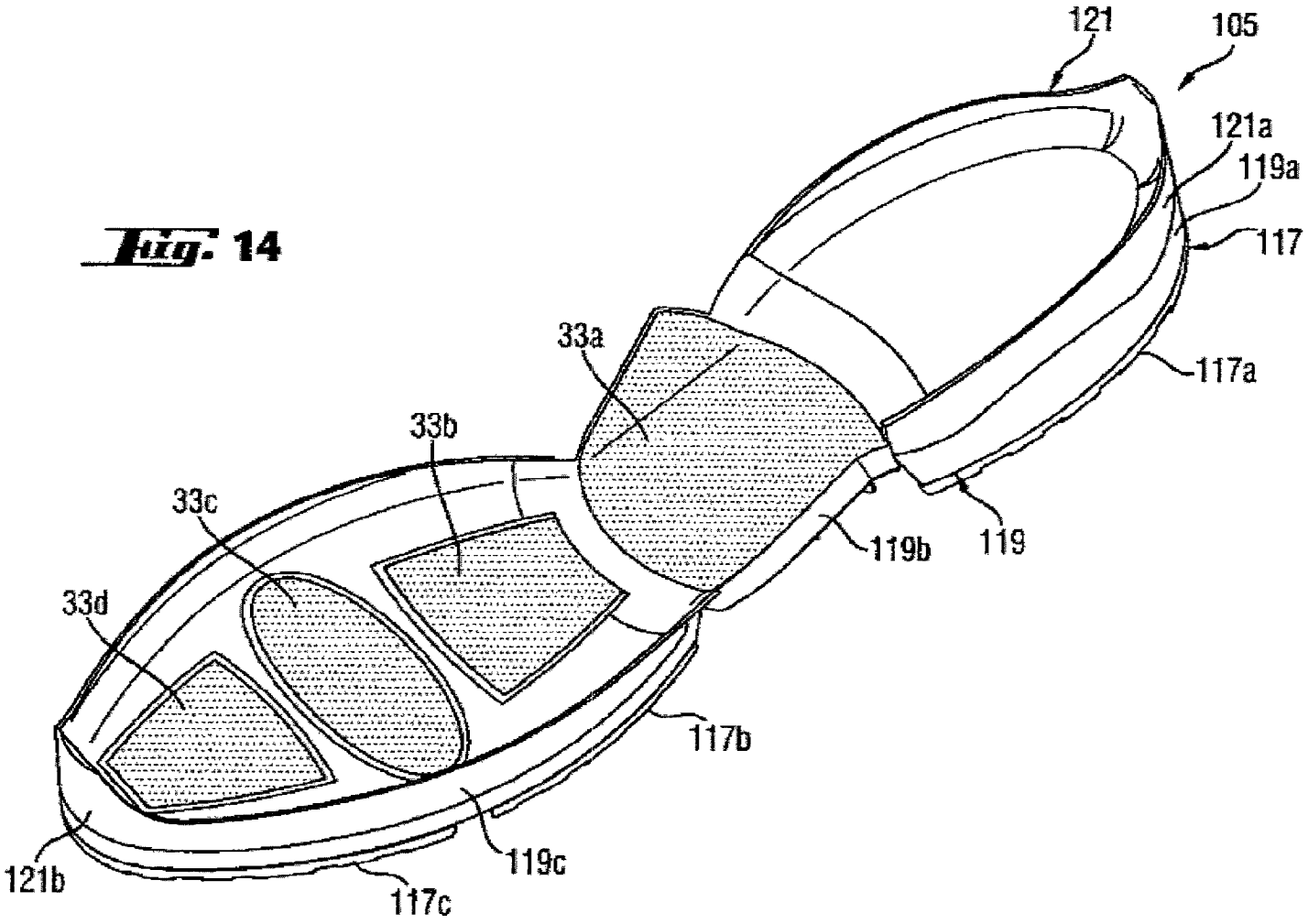

FIG. 14 shows the composite shoe sole depicted in FIG. 13*a*, in a perspective top view.

Figure 15:
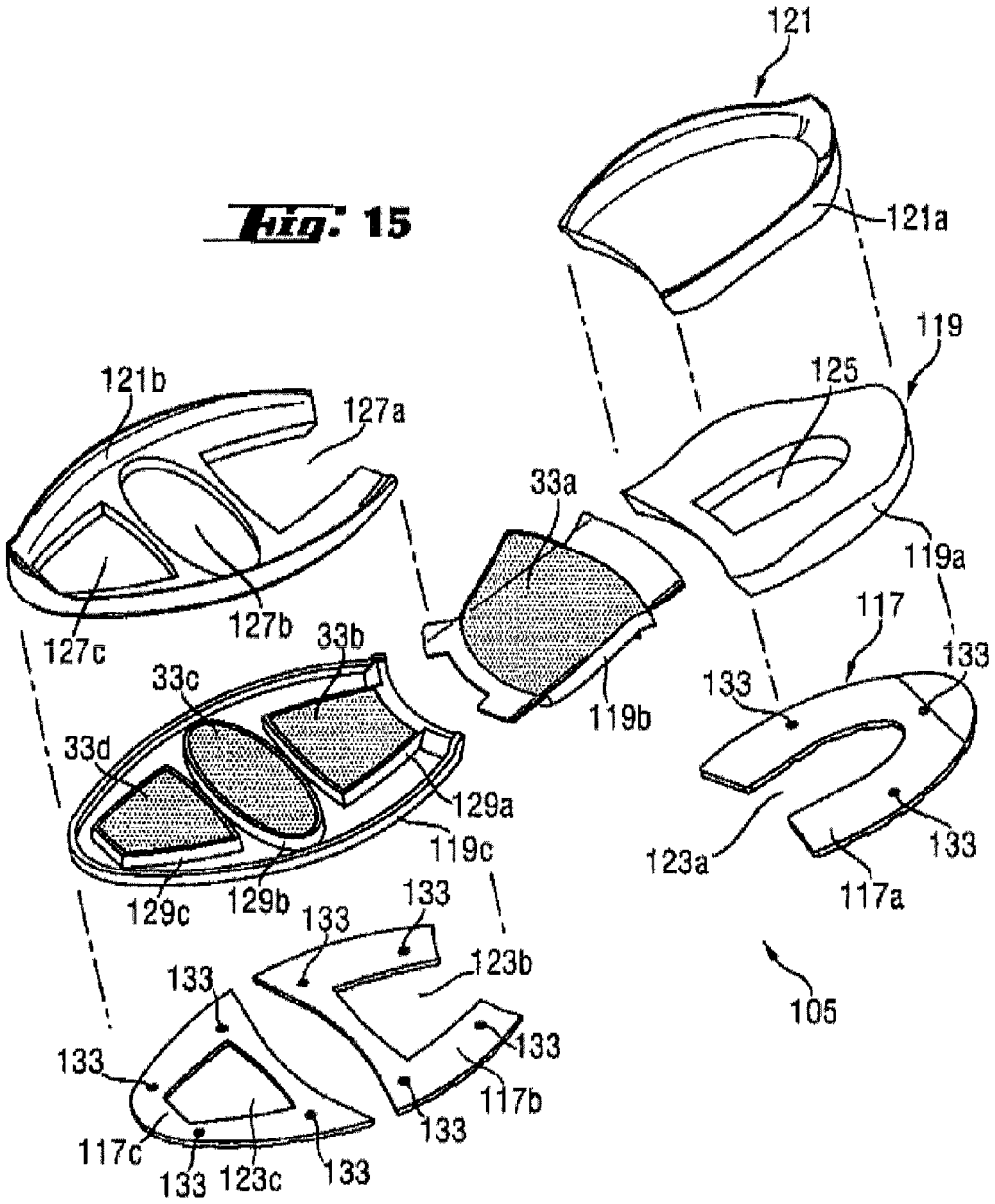

FIG. 15 shows the composite shoe sole depicted in FIG. 14 in an exploded view of its individual components, in an oblique perspective view from the top.

Figure 16:
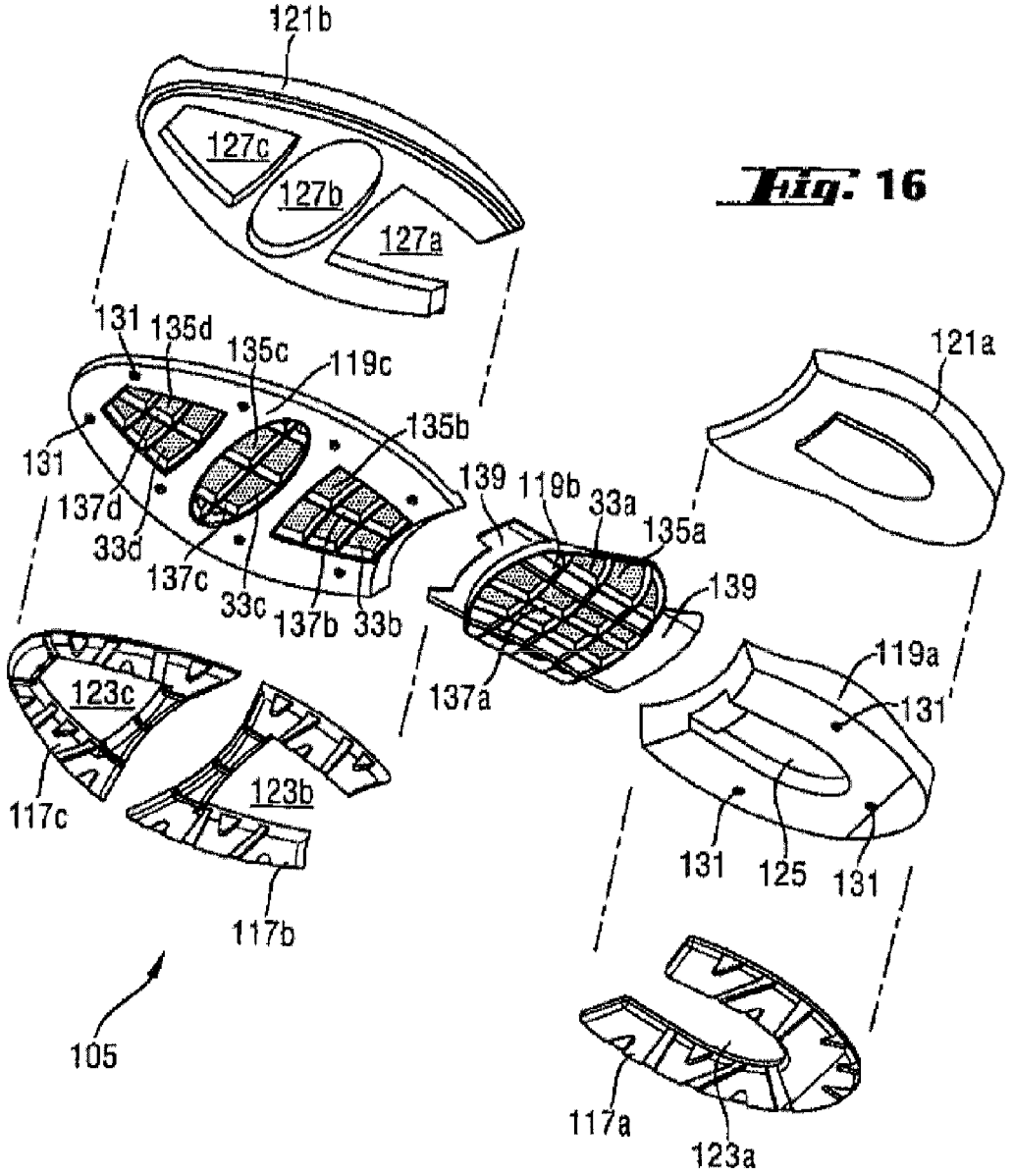

FIG. 16 shows the part of the composite shoe sole depicted in FIG. 15, in a perspective oblique view from the bottom.

Figure 17:
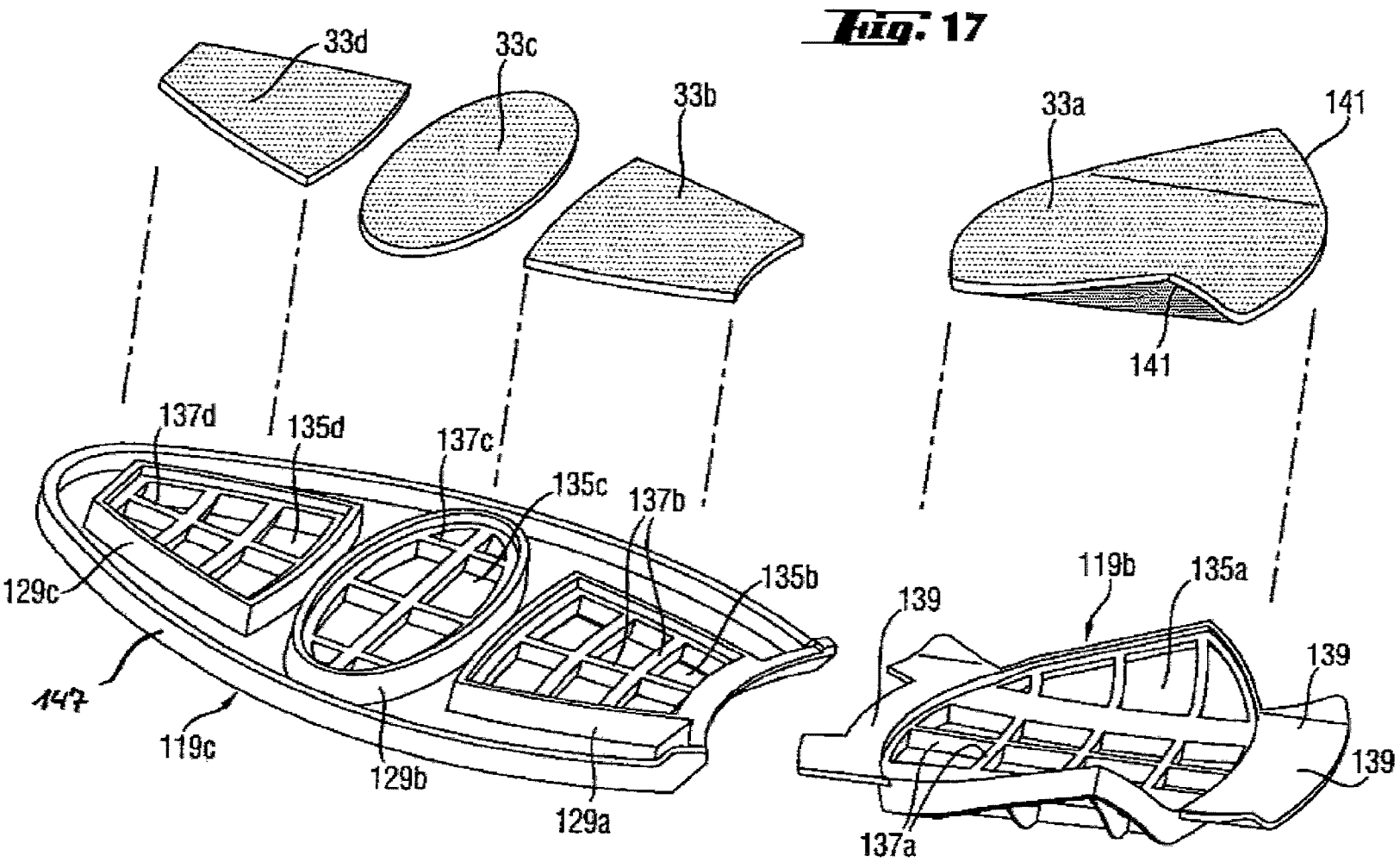

FIG. 17 shows a forefoot area and a midfoot area of the barrier unit depicted in FIG. 16, in a perspective oblique view from the top, whereby the stabilization device parts and the barrier material parts are shown separately from each other.

Figure 18:
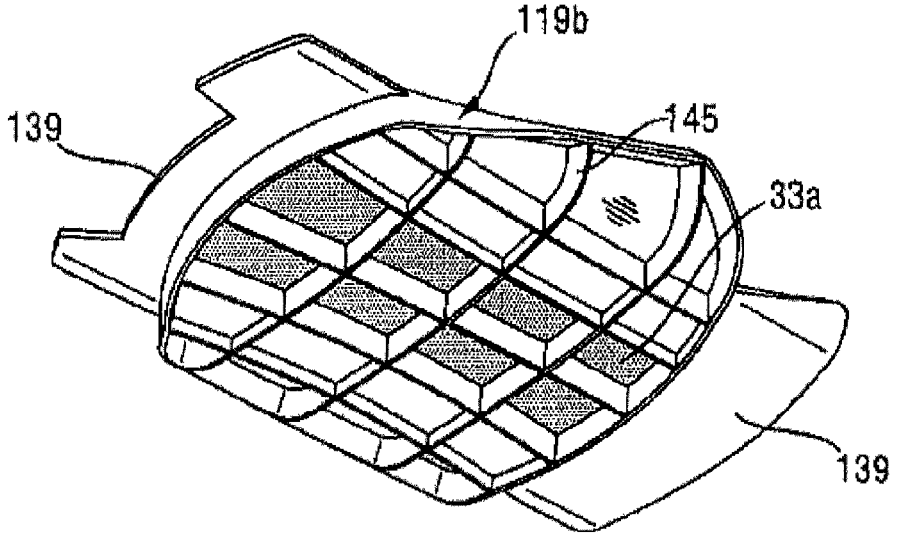

FIG. 18 shows, in a perspective oblique view from the bottom, a modification of the midfoot area of the barrier unit depicted in FIG. 17, whereby only a middle area of this barrier-unit part is occupied with barrier material and two side parts are formed without passage openings.

Figure 19:
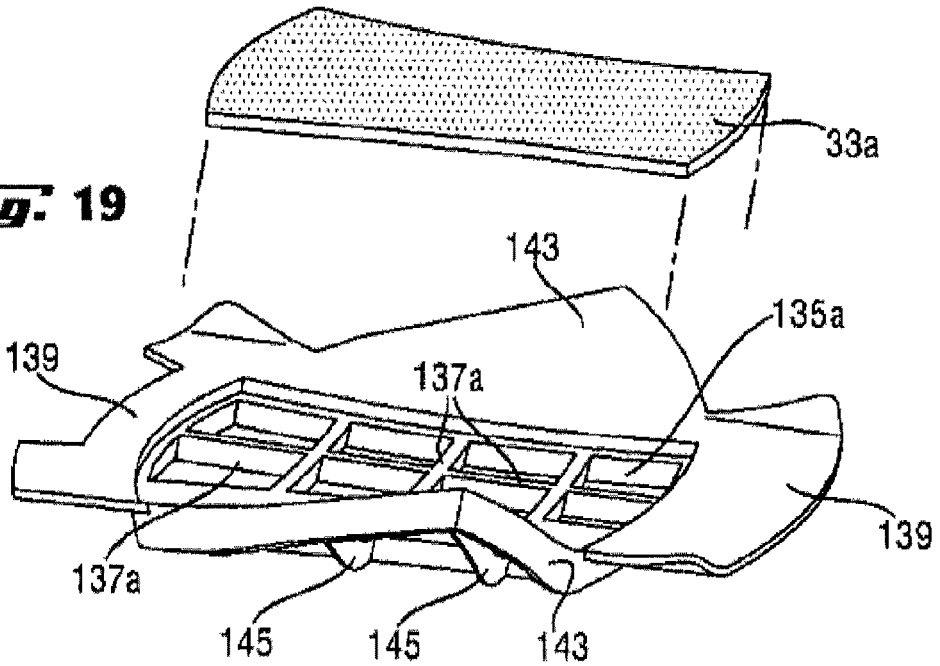

FIG. 19 shows the barrier unit part depicted in FIG. 18, in a view in which the corresponding stabilization-device part and the corresponding barrier-material part are shown separately from each other.

Figure 20:
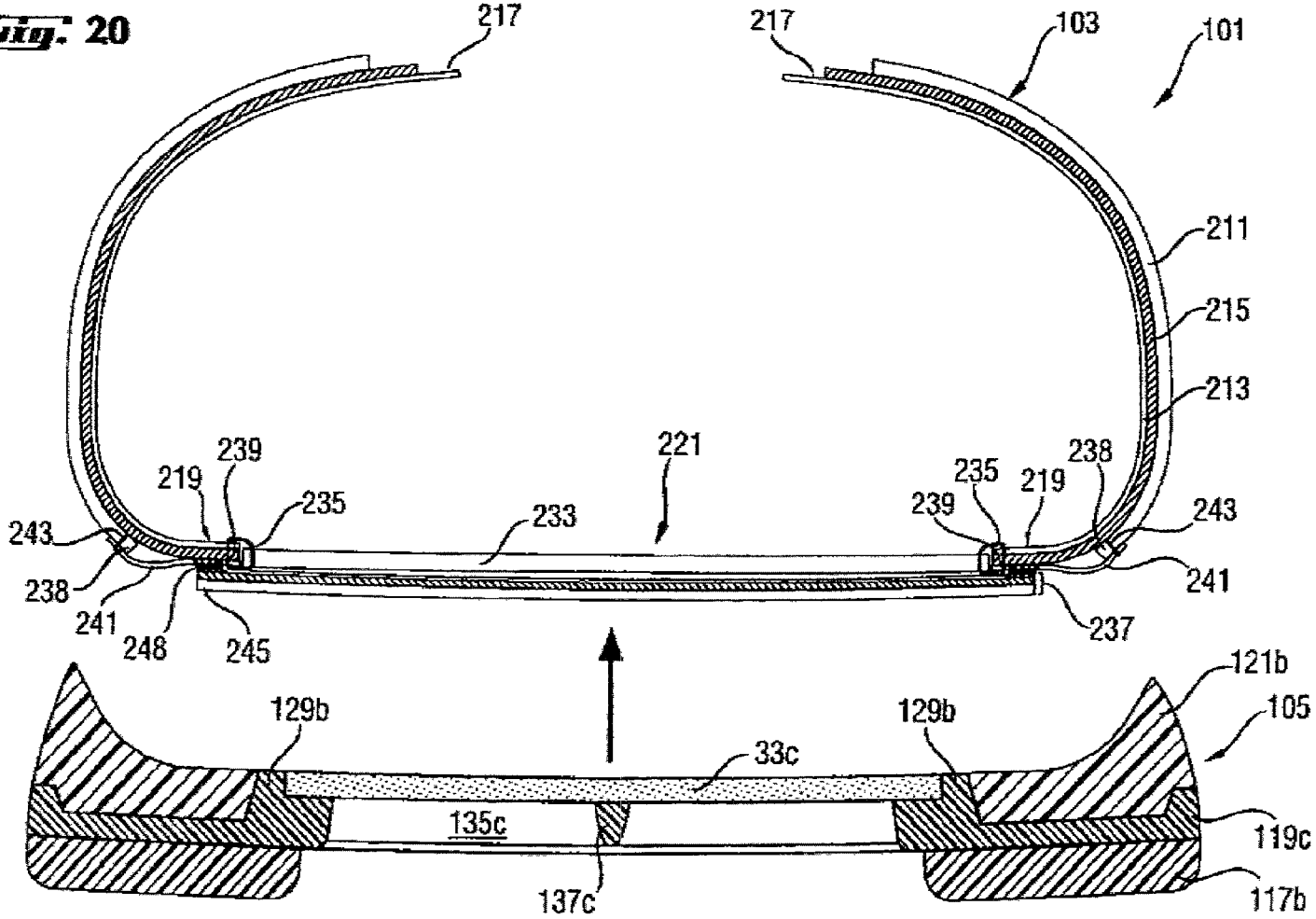

FIG. 20 shows a schematic sectional view in the forefoot area through a shaft closed on the shaft-bottom side of a first embodiment, with a composite shoe sole still not positioned on the shaft bottom.

Figure 21:
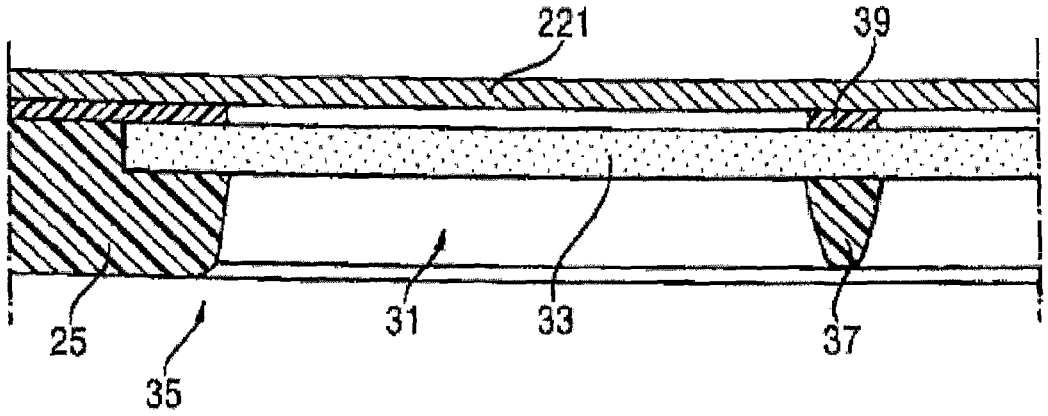

FIG. 21 shows a schematic view of another example of the barrier unit with a barrier material and a stabilization bar during selected bonding with a shaft bottom situated above it.

Figure 22:
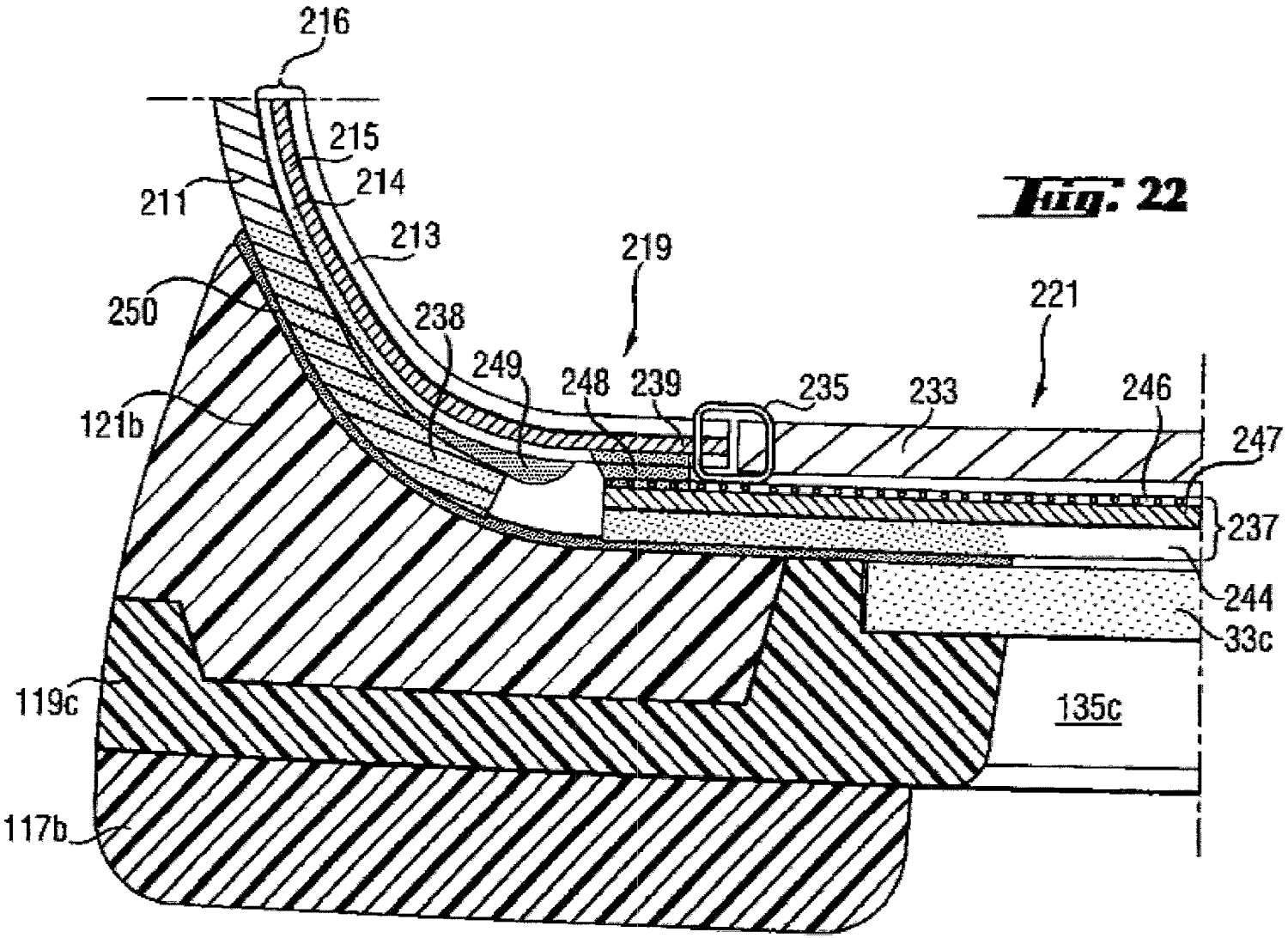

FIG. 22 shows a detail view of the shoe structure depicted in FIG. 20, with a glued-on composite shoe sole.

Figure 23:
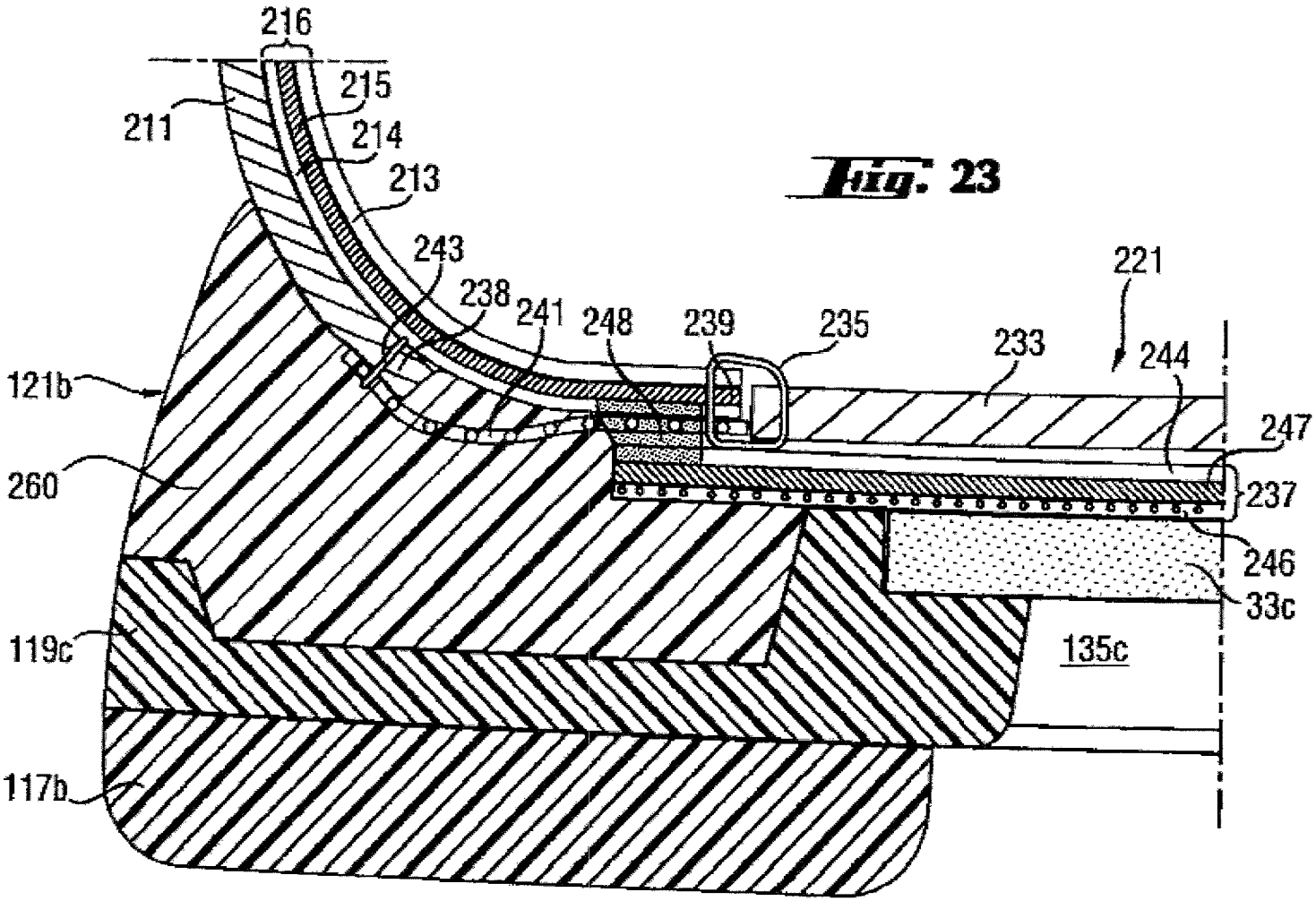

FIG. 23 shows a detail view of the sole structure depicted in FIG. 21, with a molded-on composite shoe sole.

Figure 24:
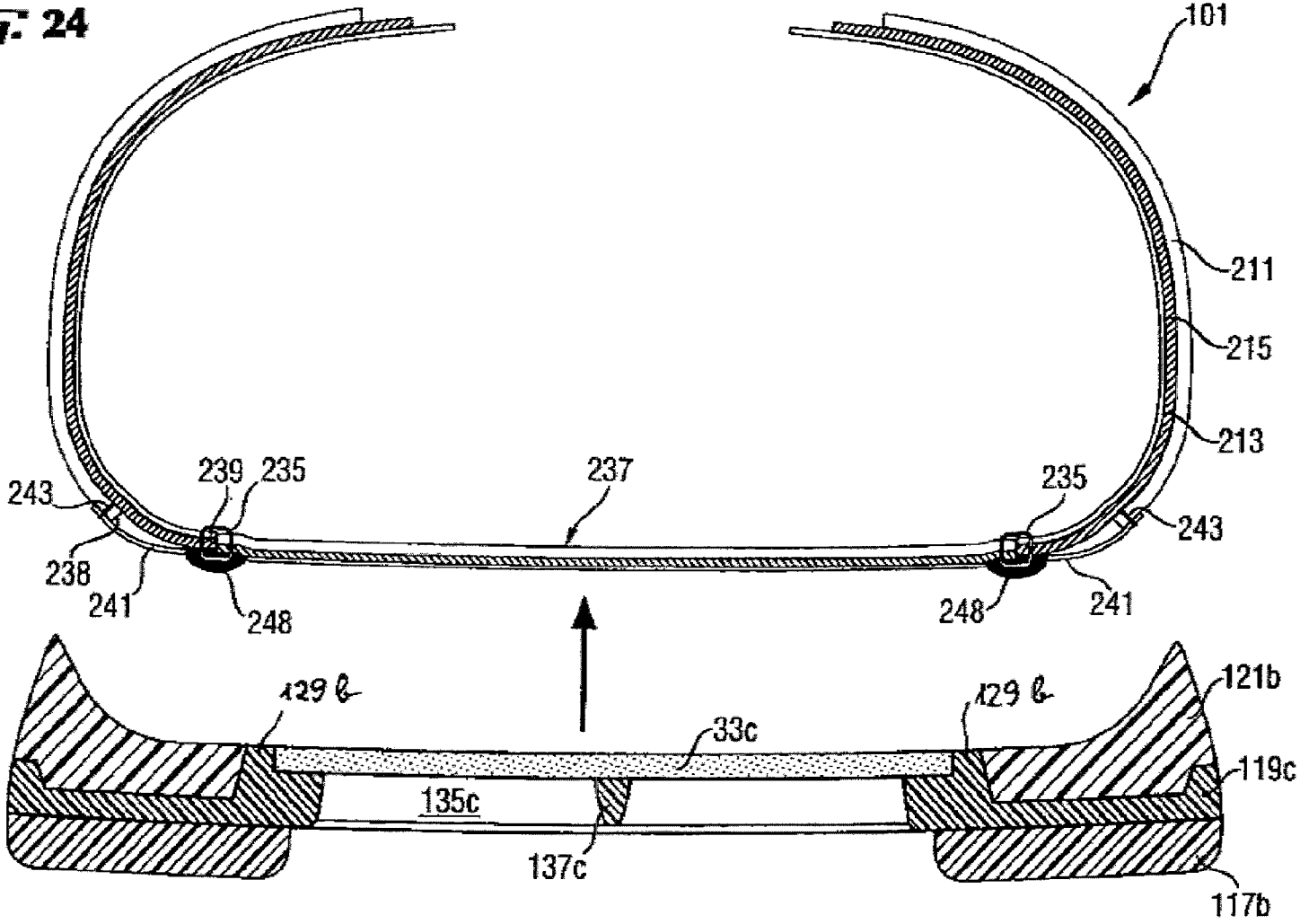

FIG. 24 shows a shoe structure similar to that shown in FIG. 20, but with a differently constructed shaft bottom, with a composite shoe sole still separated from the shaft.

Figure 25:
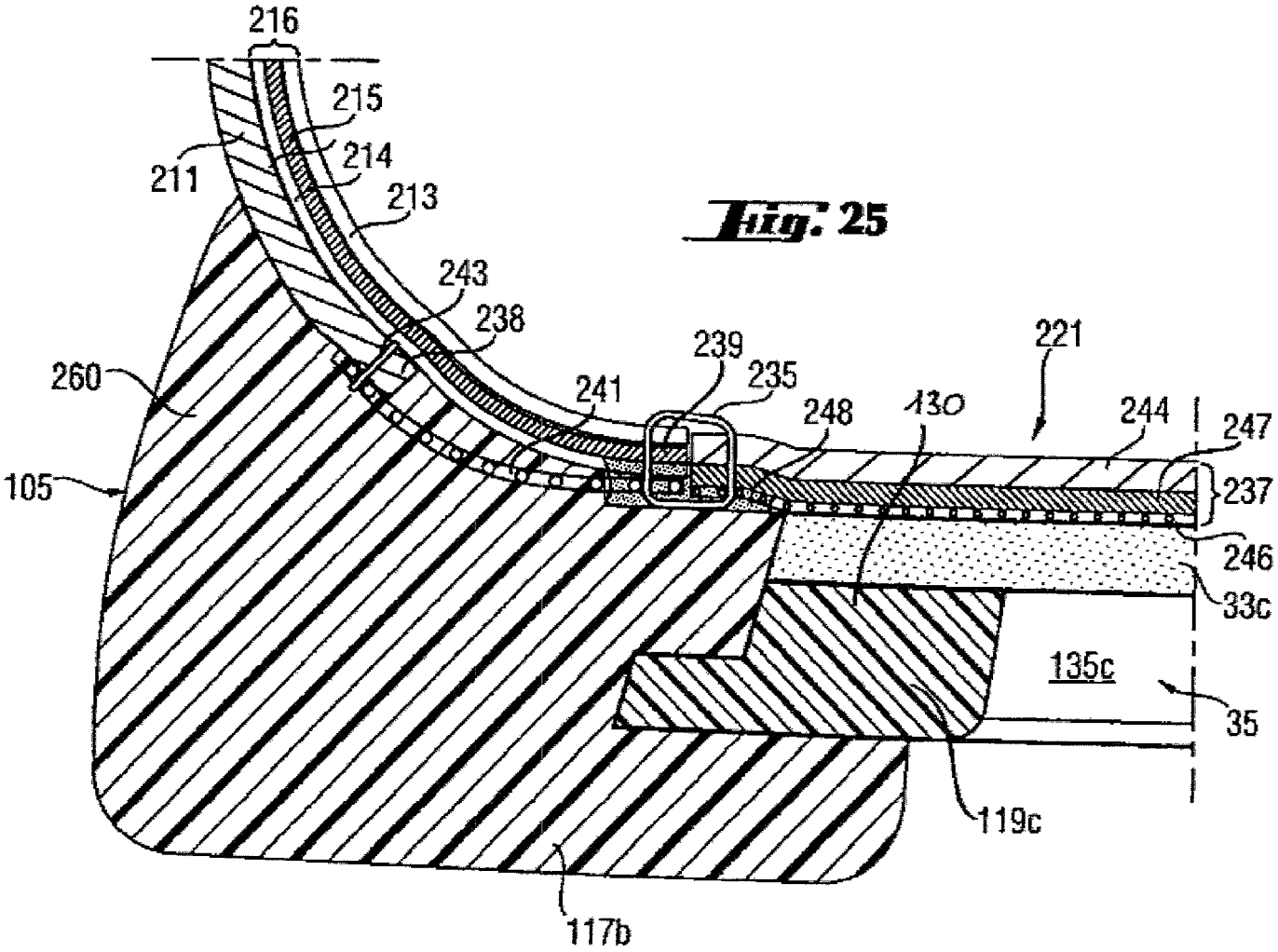

FIG. 25 shows a detail view of the shoe structure depicted in FIG. 24.

Figure 26:
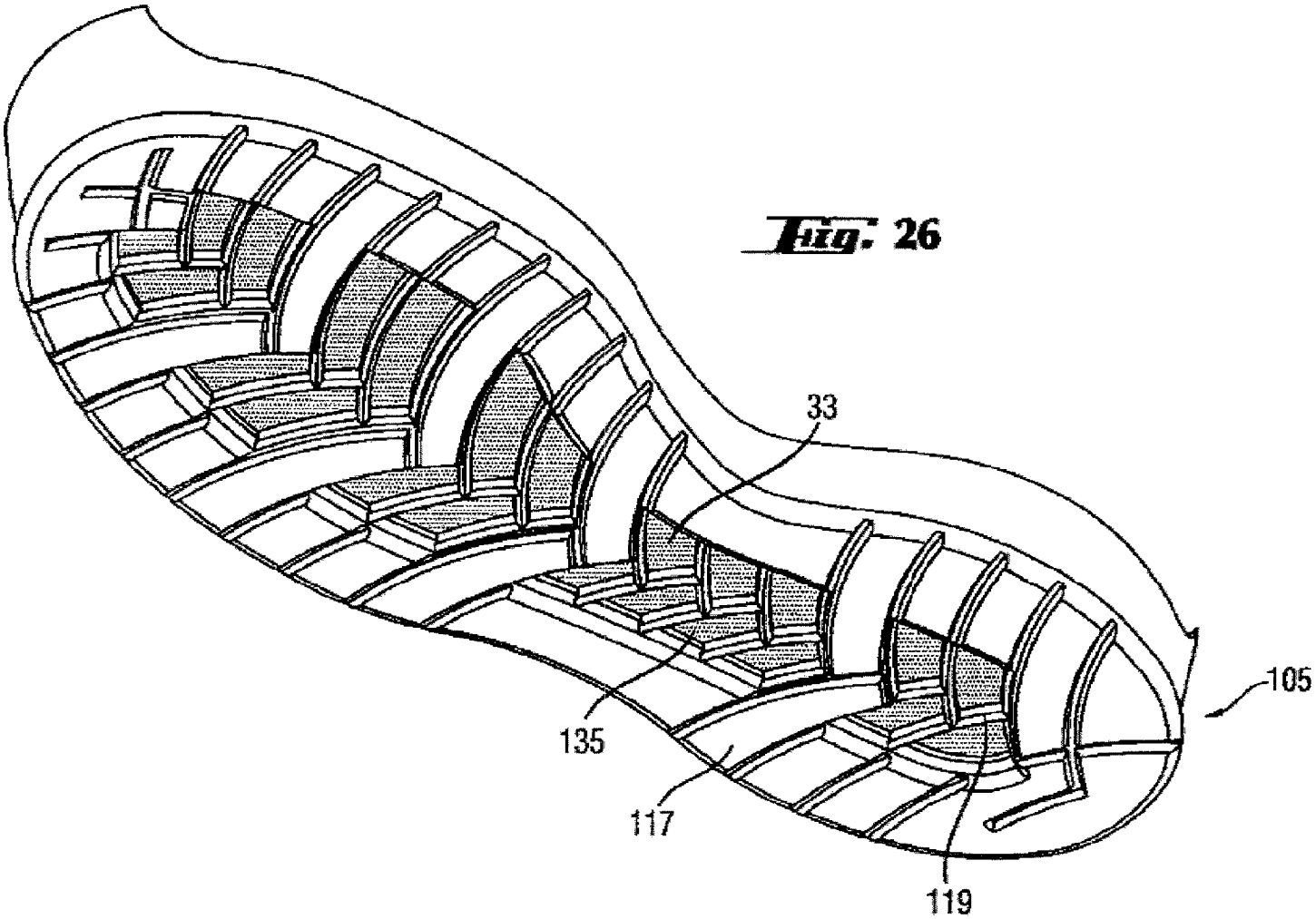

FIG. 26 shows a composite sole in another embodiment.

Figure 27:
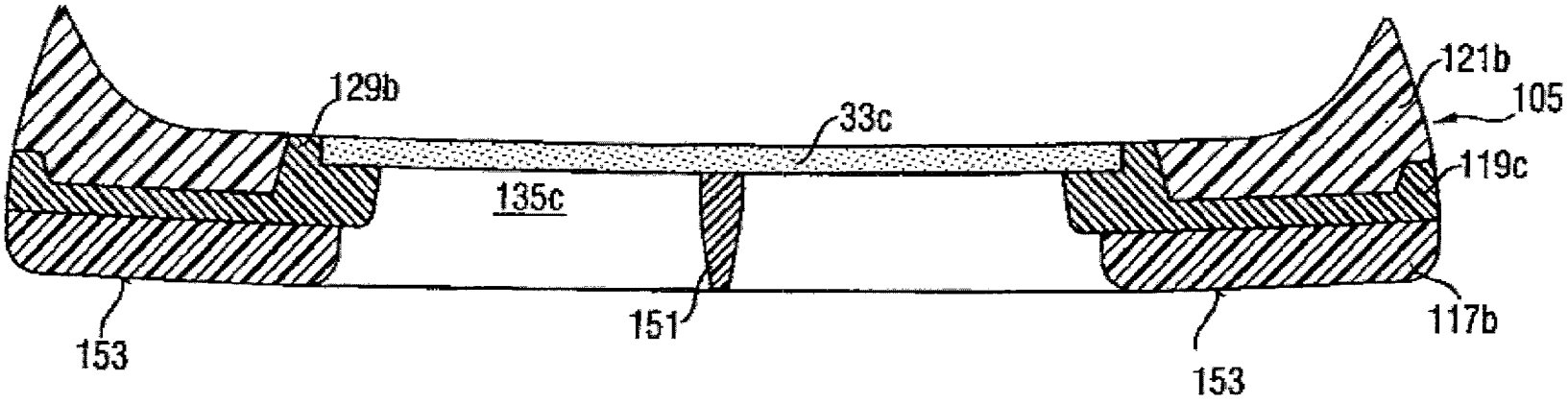

FIG. 27 shows a composite shoe sole in another embodiment.

An embodiment of a barrier material particularly suited for a composite shoe sole according to the invention will be initially explained first reference to FIGS. 1 through 3. Explanations concerning embodiments of a barrier unit according to the invention then follow, with reference to FIGS. 4 through 11. Embodiments of the footwear according to the invention and composite shoe soles according to the invention will then be explained by means of FIGS. 12 through 27.

The embodiment of the barrier material depicted in FIGS. 1 through 3 consist of a fiber composite 1 in the form of a thermally bonded and thermally surface-bonded non-woven material. This fiber composite 1 consists of two fiber components 2, 3, which are each constructed with polyester fibers. A first fiber component 2, which serves as support component of the fiber composite 1, then has a higher melting point than that of the second fiber component 3, which serves as bonding component. In order to guarantee temperature stability of the entire fiber composite 1 of at least 180° C., specifically in view of the fact that footwear can be exposed to relatively high temperatures during production, for example, during molding-on of an outsole, in the embodiment in question, polyester fibers with a melting point above 180° C. were used for both fiber components. There are different variations of polyester polymers that have different melting points and softening temperatures below them. In the embodiment in question of the barrier material according to the invention, a polyester polymer with a melting point of about 230° C. was chosen for the first component, whereas a polyester polymer with a melting point of about 200° C. is chosen for at least one fiber part of the second fiber component 3. In one embodiment, in which the second fiber component has two fiber parts in the form of a core-shell fiber structure, the core 4 consists of this fiber component from polyester with a softening temperature of about 230° C. and the shell of this fiber component consists of a polyester with an adhesive softening temperature of about 200° C. (FIG. 2*b*). Such a fiber component with two fiber parts of different melting points is also referred to as "bico," for short. This concise term will be used subsequently.

In the embodiment in question, the fibers of the two fiber components are both stable fibers with the above-mentioned special properties. With respect to the total basis weight of the fiber composite of about 400 g/m$^2$, the weight fraction of the first fiber component is about 50%. The weight fraction of the second fiber component is also about 50% with respect to the basis weight of the fiber composite. The fineness of the first fiber component is 6.7 dtex, whereas the second fiber component, designed as a bico, has a higher fineness of 4.4 dtex.

To produce such barrier materials, the fiber components present as staple fibers are first mixed. Several individual layers of this staple fiber mixture are then placed one on top of the other in the form of several individual non-woven layers, until the basis weight sought for the fiber component is reached, in which case a non-woven package is obtained. This non-woven package has only very slight mechanical stability and must therefore pass through a strengthening process.

Initially, mechanical strengthening of the non-woven package occurs by needling by means of a needle technique in which needle bars arranged in a needle matrix penetrate the non-woven package perpendicular to the plane of extension of the non-woven package. Fibers of the non-woven package are reoriented by this from their original position in the non-woven package, so that balling of the fibers and a more stable mechanical structure of the non-woven package occur. A non-woven material mechanically strengthened by such needling is schematically shown in FIG. 1.

The thickness of the non-woven package with respect to the initial thickness of the unneedled non-woven package is already reduced by the needling process. However, this structure obtained by needling is still not permanently tenable, since it is a purely mechanical three-dimensional "hooking" of stable fibers, which can be "unhooked" again under stress.

In order to achieve permanent stabilization, namely a stabilizing property for the use in footwear, the fiber composite is further treated according to the invention. Thermal energy and pressure are then used. In this process, the advantageous composition of the fiber mixture is utilized, in which a temperature is chosen for thermal bonding of the fiber mixture, so that it lies at least in the range of the adhesive softening temperature of the shell of the core-shell bico that melts at a lower melting point, in order to soften it into a viscous state, so that the fiber parts of the first fiber component, which is situated in the vicinity of the softened mass of the shell of the corresponding bico, can be partially incorporated in this viscous mass. Because of this, the two fiber components are permanently bonded to each other without changing the fundamental structure of the non-woven material. The advantageous properties of this non-woven material can also be utilized, especially its good water-vapor permeability combined with a permanent mechanical-stabilization property.

Such a thermally bonded non-woven material is shown schematically in FIG. 2, in which a detailed view of a cutout on a highly enlarged scale is shown in FIG. 2*a*, in which the glue-bonding points between individual fibers are shown by flat black spots, and FIG. 2*b* shows an area of the cutout on an even larger scale.

In addition to thermal bonding of the non-woven material, thermal surface compression can be performed on at least one surface of the non-woven material by exposing the surface of this non-woven material simultaneously to the effect of pressure and temperature, for example, by means of heating compression plates or compression rollers. The result is even stronger bonding than in the remaining volume of the non-woven material and smoothing of the thermally compressed surface.

A non-woven material initially mechanically bonded by needling, then thermally bonded, and finally thermally surface-compressed on one of its surfaces, is shown schematically in FIG. 3.

In an accompanying comparison table, various materials, including barrier materials according to the invention, are compared with respect to some parameters. Split sole leather, two non-woven materials only needle-bonded, a needle-bonded and thermally bonded non-woven material, and, finally, a needle-bonded, thermally bonded, and thermally surface-compressed non-woven material are then considered, whereby these materials, for simplicity of the subsequent treatment of the comparison table, are assigned the material numbers 1 to 5 in the comparison table.

The longitudinal elongation values and the transverse elongation values show the percentage by which the corresponding material expands when acted upon with a stretching force of 50 N, 100 N, or 150 N. The lower the longitudinal and transverse elongation, the more stable and better suited as a barrier material the material is. If the corresponding material is used as a barrier material to protect the membrane against penetration of foreign objects, such as pebbles, puncture resistance is important. The abrasion strength, called abrasion in the comparison table, is also significant for use of the corresponding material in a composite shoe sole.

It can be seen from the comparison table that split sole leather does have high tensile strength, relatively good resistance to stretching forces, and high puncture resistance, but it only has moderate abrasion strength during wet tests, and especially quite moderate water-vapor permeability.

The only needle-bonded non-woven materials (material 2 and material 3) are relatively light and have high water-vapor permeability in comparison with leather, but they have relatively low stretching resistance in terms of stretching forces, possess only limited puncture resistance, and have only moderate abrasion strength.

The needle-bonded and thermally bonded non-woven material (material 4), at a lower thickness, has a higher basis weight than materials 2 and 3, and is therefore more compact. The water-vapor permeability of material 4 is higher than that of material 2 and about as high as that of material 3, but almost three times as high as that of leather according to material 1. The longitudinal and transverse elongation resistances of material 4 are much higher than those of non-woven materials 2 and 3, which are only needle-bonded and the longitudinal and transverse breaking load is also much higher than that of materials 2 and 3. The puncture resistance and abrasion strength in material 4 are also much higher than in materials 2 and 3.

Material 5, i.e., the needle-bonded, thermally bonded, and non-woven material thermally compressed on one of its surfaces, has a lower thickness than material 4, because of thermal surface compression with the same basis weight, and therefore takes up less room in a composite shoe sole. The water-vapor permeability of material 5 still lies above that of material 4. With respect to elongation resistance, material 5 is also superior to material 4, since it shows no elongation when longitudinal and transverse elongation forces of 50 N to 150 N are applied. The tensile strength is higher with respect to longitudinal loading and lower with respect to transverse loading than that of material 4. The puncture resistance is somewhat below that of material 4, which is caused by the more limited thickness of material 5. A special superiority compared to all materials 1 to 4 is exhibited by material 5 with respect to abrasion strength.

The comparison table therefore shows that when high water-vapor permeability, high shape stability, and therefore a stabilization effect and a high abrasion resistance are required in the material, material 4, and especially material 5, are quite particularly suited.

In the case of material 5, the needle-bonded and thermally bonded non-woven material, which also has very good stabilization, in one embodiment of the invention is then subjected to hydrophobic finishing, for example, by a dipping process in a liquid that causes hydrophobization, in order to minimize suction effects of the non-woven material. After the hydrophobization bath, the non-woven material is dried under the influence of heat, whereby the hydrophobic property of the applied finishing is further improved. After the drying process, the non-woven material passes through sizing rollers, whereby the final thickness of, say, 1.5 mm is also set.

In order to achieve a particularly smooth surface, the non-woven material is then exposed to temperature and pressure again, in order to melt the fiber parts, namely the second fiber component in the shell of the bico on the surface of the non-woven material and to press it against a very smooth surface by means of pressure applied simultaneously. This occurs either with appropriate calendering devices or by means of a heated compression die, whereby a separation material layer can be introduced between the non-woven and material the heated pressure plate, which can be silicone paper or Teflon, for example.

Surface smoothing by thermal surface compression is performed on only one surface or both surfaces of the non-woven material, depending on the desired properties of the barrier material.

As already shown by the comparison table, the non-woven material thus produced has high stability against a tearing load and possesses good puncture resistance, which is important when the material is used as a barrier material to protect a membrane.

Material 5, just described, represents a first example embodiment of the barrier material used according to the invention, in which both fiber components consist of polyester, both fiber components have a weight percentage of 50% in the total fiber composite, and the second fiber component is a polyester core-shell fiber of the bico type.

Additional example embodiments of the barrier material used according to the invention will now be considered briefly:

EXAMPLE EMBODIMENT 2

A barrier material, in which both fiber components consist of polyester and have a weight percentage of 50% each in the total fiber composite, and the second fiber component is a bico from polyester of the side-by-side type.

Except for the special bico structure, the barrier material according to example embodiment 2 is produced in the same way and has the same properties as the barrier material according to example embodiment 1 with a bico fiber of the core-shell type.

EXAMPLE EMBODIMENT 3

A barrier material, in which both fiber components have a weight percentage of 50% and the first fiber component is a polyester and the second fiber component is a polypropylene.

In this example embodiment, no bico is used, but a single-component fiber is instead used as the second fiber component. For production of this fiber composite, only two fiber components with different melting points are chosen. In this case, the polyester fiber (with a melting point of about 230° C.) with a weight fraction of 50% represents the support component, whereas the polypropylene fiber, also with a weight fraction of 50%, has a lower melting point of about 130° C. and therefore represents the gluable bonding component. The production process otherwise runs as in example embodiment 1. In comparison to example embodiment 2, the non-woven material according to example embodiment 3 has lower heat stability, but it can also be produced using lower temperatures.

EXAMPLE EMBODIMENT 4

A barrier material with a percentage of 80% polyester as the first fiber component and a polyester core-shell bico as the second fiber component.

In this example embodiment, production again occurs as in example embodiment 1, the only difference being that the percentage of the second fiber component, which forms the bonding component, is changed. Its weight percentage is now only 20% compared to 80% of the weight formed by the first fiber component, which has a higher melting point. Because of the proportionate reduction in the bonding component, the stabilizing effect of the barrier material obtained is reduced. This can be advantageous when a non-woven material with high mechanical lifetime combined with increased flexibility is required. The temperature resistance of this non-woven material corresponds to that of the first example embodiment.

Some example embodiments of a composite shoe sole and a barrier unit and details of it are now considered by means of FIGS. 4 through 11.

Figure 4:
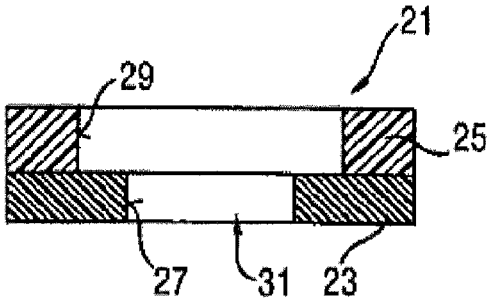
FIG. 4 shows a schematic view of a composite shoe sole, still without barrier material, showing the opening extending through the thickness of the composite shoe sole.

FIG. 4 shows a partial cross-section through a composite shoe sole 21 with an underlying outsole 23 and a shoe stabilization device 25 situated above it, before this composite shoe sole 21 is provided with a barrier material. The outsole 23 and the shoe-stabilization device 25 each have openings 27 and 29, which together form a passage 31 through the total thickness of the composite shoe sole 21. The passage 31 is therefore formed by the intersection surface of the two passage openings 27, 29. To complete this composite shoe sole 21, a barrier material 33 (not shown in FIG. 4) is placed in the passage opening 29 or arranged above it.

Figure 5:
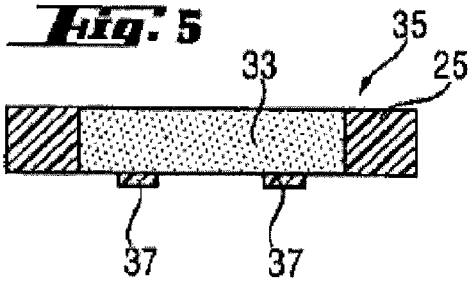
FIG. 5 shows a schematic view of a first example of a barrier unit with a stabilization device having a bar and a barrier material accommodated in it.

FIG. 5 shows an example of a barrier unit 35 with a piece of barrier material 33 held by a stabilization device 25.

In one embodiment, the stabilization device is molded around the peripheral area of the piece of barrier material 33 or molded onto it, so that the material of the stabilization device 25 penetrates into the fiber structure of the barrier material 33 and is cured there and forms a solid composite.

As a material for molding of the stabilization device or molding onto the stabilization device, thermoplastic polyurethane (TPU) is suitable, which leads to very good enclosure of the barrier material and can be well bonded to it.

In another embodiment, the barrier material 33 is glued to the stabilization device 25. The stabilization device 25 preferably has a stabilization frame that stabilizes at least the composite show sole 21 and at least one stabilization bar 37, which is arranged on a surface of the barrier material 33. The at least one stabilization bar 37 is preferably arranged on the bottom of the barrier material 33 facing the outsole.

Figure 6:
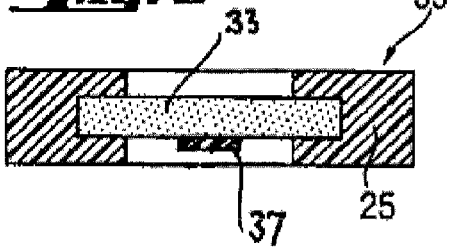
FIG. 6 shows a schematic view of another example of a barrier unit with a stabilization device having a bar and a barrier material.

FIG. 6 shows a barrier unit 35, in which a piece of barrier material 33 is enclosed by a stabilization device 25 in the sense that the edge area of the barrier material 33 is not only surrounded by the stabilization device 25, but also held on both surfaces.

Figure 7:
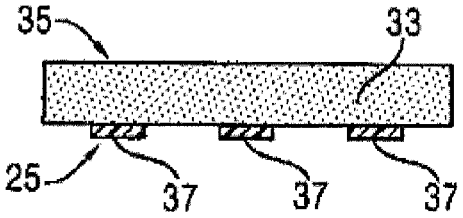
FIG. 7 shows a schematic view of additional examples of a barrier unit with a stabilization device in the form of at least one bar.

FIG. 7 shows a barrier unit 35, in which a piece of barrier material 33 is provided with a stabilization device 25 in the form of at least one stabilization bar 37. The stabilization bar 37 is arranged on at least one surface of the barrier material 33, preferably on the surface facing downward toward the outsole 23.

Figure 8:
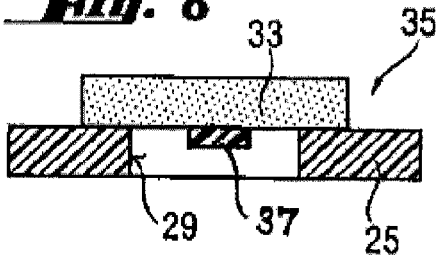
FIG. 8 shows a schematic view of another example of a barrier unit with a stabilization device having a bar and a barrier material.

FIG. 8 shows a barrier unit 35, in which a piece of barrier material 33 is provided with a stabilization device 25, so that the barrier material 33 is applied to at least one surface of the stabilization device 25. The barrier material 33 then covers the passage opening 29. The stabilization bar 37 is situated within the passage opening 29 of the stabilization device 25.

Figure 9:
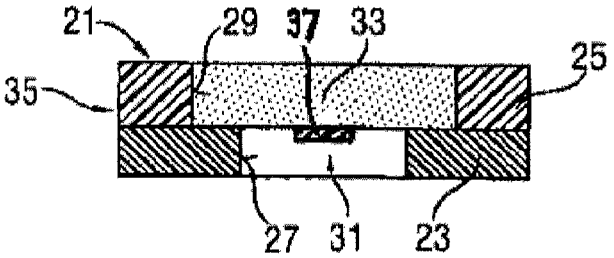
FIG. 9 shows a schematic view of the composite shoe sole depicted in FIG. 4 with barrier material and a stabilization device, having a bar.

FIG. 9 shows a composite shoe sole 21 according to FIG. 4, which has a barrier unit according to FIG. 5 above the outsole 23, whereby only one stabilization bar 37 is shown.

For all the embodiments according to FIGS. 4 to 9 described above, it is true that the bonding material during molding on, molding around, or gluing between the barrier material 33 and the stabilization device 25, not only adheres to the surfaces being joined, but also penetrates into the fiber structure and cures there. The fiber structure is therefore additionally strengthened in its joining area.

Figure 10:
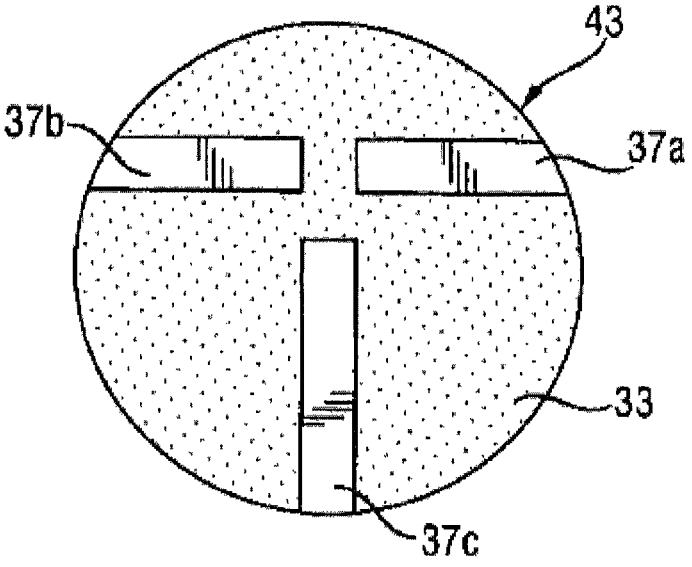
FIG. 10 shows a schematic view of stabilization bars arranged on the bottom of the barrier material.
Figure 11:
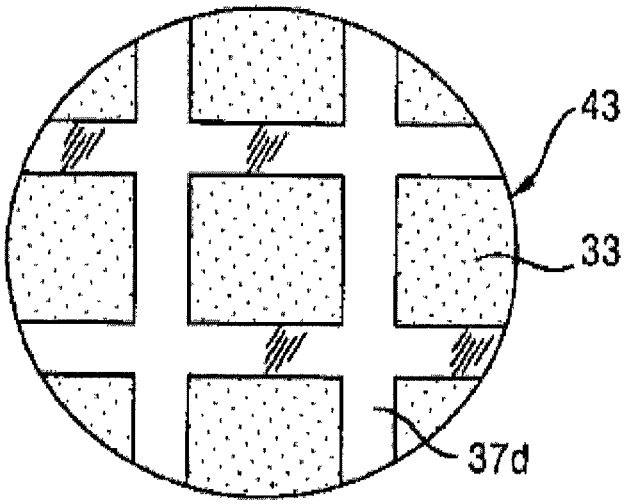
FIG. 11 Shows a schematic view of a stabilization mesh arranged on the bottom of the barrier material.

Two embodiments of stabilization-bar patterns of stabilization bars 37 applied to a surface of the barrier material 33 are shown in FIGS. 10 and 11. Whereas, in the case of FIG. 10, three individual bars 37*a*, 37*b*, and 37*c* are arranged in a T-shaped mutual arrangement on a circular surface 43, for example, the bottom of barrier material 33, which corresponds to a trough hole of the composite shoe sole 21, for example, by gluing onto the bottom of the barrier material, in the case of FIG. 11, a stabilization-bar device in the form of a stabilization mesh 37*d* is provided.

Embodiments of shoes designed according to the invention will now explained with reference to FIGS. 12 through 27, whereby their individual components will also be considered, especially in connection with the corresponding composite shoe sole.

FIG. 12 shows, in a perspective oblique view from the bottom, an example embodiment of a shoe 101 according to the invention with a shaft 103 and a composite shoe sole 105 according to the invention. The shoe 101 has a forefoot area 107, a midfoot area 109, a heel area 111, and a foot-insertion opening 113. The composite shoe sole 105 has a multipart outsole 117 on its bottom, which has an outsole part 117*a* in the heel area, an outsole part 117*b* in the area of the ball of the foot, and an outsole part 117*c* in the toe area of the composite shoe sole 105. These outsole parts 117 are attached to the bottom of a stabilization device 119, which has a heel area 119*a*, a midfoot area 119*b*, and a forefoot area 119*c*. The composite shoe sole 105 will be further explained in detail with reference to the following diagrams.

Additional components of the composite shoe sole 105 can be damping sole parts 121*a* and 121*b*, which are applied in the heel area 111 and in the forefoot area 107 on the top of the stabilization device 119. The outsole 117 and the stabilization device 119 have passage openings that form trough holes through the composite shoe sole. These trough holes are covered by barrier materials 33*a*-33*d* in a water-vapor-permeable manner.

FIG. 13*a* shows the shoe 101 according to FIG. 12 in a manufacturing stage in which the shaft 103 and the composite shoe sole 105 are still separate from each other. The shaft 103 is provided on its lower end area on the sole side with a shaft bottom 221, which has a waterproof, water-vapor-permeable shaft-bottom functional layer, which can be a waterproof, water-vapor-permeable membrane. The functional layer is preferably a component of a multilayer functional-layer laminate that has at least one protective layer, for example, a textile backing, as processing protection, in addition to the functional layer. The shaft bottom 115 can also be provided with a shaft-mounting sole. However, there is also the possibility of assigning the function of shaft-mounting sole to the functional-layer laminate. The composite shoe sole also has the trough holes 31 already mentioned in FIG. 8, which are covered with barrier-material parts 33*a*-33*d*. The bars 37 are shown within the peripheral edge of the corresponding trough holes. In other embodiments, three trough holes, two trough holes, one trough hole can be provided. In another embodiment, more than four trough holes are provided. The composite shoe sole 105 can be attached to the shaft end on the sole side, either by molding on or gluing, in order to produce the state according to FIG. 12. For a detailed explanation of the functional layer and its laminate and the connection with the mounting sole, refer to the description and FIGS. 20 to 25 are referred to.

FIG. 13*b* shows the same shoe structure as in FIG. 13*a*, with the difference that the shoe in FIG. 13*a* has four trough holes 31, whereas the shoe according to FIG. 13*b*, is provided with two trough holes 31. It can be seen here that the bars 37 are arranged within the peripheral edge of the corresponding trough hole 31 and do not form a limitation of the trough hole 31. The surface of a trough hole is determined minus the total surface of the bars bridging it, since this bar surface blocks water-vapor transport.

FIG. 14 shows a composite shoe sole 105 with a top lying away from the outsole 117. On the top lying away from the outsole 117, the stabilization device 119 is covered in its middle area 119*b* and its forefoot area 119*c* with several pieces 33*a*, 33*b*, 33*c*, and 33*d* of a barrier material 33, with which trough holes of the composite shoe sole 105 (not visible in FIG. 14) are covered. In the heel area and in the forefoot area of the composite shoe sole 105, a damping sole part 121*a* and 121*b* is applied to the top of the stabilization device 119, essentially over the entire surface in the heel area and with recesses in the forefoot area wherever the barrier material parts 33*b*, 33*c* and 33*d* are situated.

Since the outsole parts of outsole 117, the stabilization device 119, and the damping sole parts 121*a* and 121*b* have different functions within the composite shoe sole, they are appropriately also constructed with different materials. The outsole parts, which are supposed to have good abrasion resistance, consist, for example, of a thermoplastic polyurethane (TPU) or rubber. Thermoplastic polyurethane is the term for a number of different polyurethanes that can have various properties. For an outsole, a thermoplastic polyurethane can be chosen with high stability and slip resistance. The damping sole parts 121*a* and 121*b*, which are supposed to produce shock absorption during walking movements of the user of the shoe, consist of correspondingly elastically compliant material, for example, ethylene-vinyl acetate (EVA) or polyurethane (PU). The stabilization device 119, which serves as a holder for the non-coherent outsole parts 117*a*, 117*b*, 117*c* and for the also non-coherent damping sole parts 121*a*, 121*b* and serves as a stabilization element for the entire composite shoe sole 105 and is supposed to have corresponding elastic rigidity, consists of at least one thermoplastic material. Examples of appropriate thermoplastic materials are polyethylene, polyamide, polyamide (PA), polyester (PET), polyethylene (PE), polypropylene (PP), and polyvinylchloride (PVC). Other appropriate materials are rubber, thermoplastic rubber (TR), and polyurethane (PU). Thermoplastic polyurethane (TPU) is also suitable.

The composite shoe sole depicted in FIG. 14 is shown in an exploded view in FIG. 15, i.e., in a view in which the individual parts of the composite shoe sole 105 are shown separately from each other, except for the barrier material parts 33*a*, 33*b*, 33*c*, and 33*d*, which are already shown arranged on the stabilization device parts 119*b* and 119*c*. In the embodiment depicted in FIG. 15, the stabilization device 119 has its parts 119*a*, 119*b*, and 119*c* as initially separate parts, which are joined together to the stabilization device 119 during assembly of the composite shoe sole 105, which can occur by welding or gluing of the three stabilization device parts to one another. As will still be explained in connection with FIG. 16, openings are situated beneath the barrier material parts, which, together with openings 123*a*, 123*b*, and 123*c* in the outsole parts 117*a*, 117*b*, and 117*c*, form trough holes 30 of the type already explained in connection with FIG. 4, and with which barrier material parts 33*a*-33*d* are covered in a water-vapor-permeable manner. A passage opening 125 in the heel part 119*a* of the stabilization device 119 is not closed with barrier material 33, but with the full-surface damping sole part 121*a*. A better damping effect of the composite shoe sole 105 in the heel area of the shoe is thereby achieved, where sweat-moisture removal, under some circumstances, can be less required, since foot sweat mostly forms in the forefoot and midfoot areas, but not in the heel area.

The damping sole part 121*b* is provided with passage openings 127*a*, 127*b*, and 127*c*, which are dimensioned so that the barrier material parts 33*b*, 33*c*, 33*d* can be accommodated within an enclosing limitation edge 129*a*, 129*b*, or 129*c* of the stabilization device part 119*c* in passage openings 127*a*, 127*b*, and 127*c*.

In another embodiment, no damping sole part 121 is proposed. In this case, the parts of the stabilization device 119*a*, 119*b*, and 119*c* have a flat surface without a limitation edge 129*a*, 129*b*, 129*c*, so that the barrier material 33 is positioned flush with the surface of the stabilization device in its openings. The composite sole is only formed by the barrier unit, which is constructed from the barrier unit 33, the stabilization device 119, and the outsole.

The composite shoe sole parts 105 shown in FIG. 15 are shown obliquely in FIG. 16 in an arrangement separate from one another, but in an oblique view from the bottom. It can be seen that the outsole parts 117*a* to 117*c* are provided in the usual manner with an outsole profile, in order to reduce the danger of slipping. The bottoms of the stabilization device parts 119*a* and 119*e* on their bottom also have several knob-like protrusions 131, which serve to accommodate the complementary recesses seen in FIG. 15 in the tops of outsole parts 117*a*, 117*b*, and 117*c* for positionally correct joining of the outsole parts 117*a* to 117*c* to the corresponding stabilization device parts 119*a* and 119*c*. Openings 135*a*, 135*b*, 135*c*, and 135*d* are also visible in the stabilization device parts 119*b* and 119*d* in FIG. 16, which are covered with the corresponding barrier material 33*a*, 33*b*, 33*c*, and 33*d* in a water-vapor-permeable manner, so that the trough holes 31 (FIG. 4) of the composite shoe sole 105 are closed in a water-vapor-permeable manner. In one embodiment, the barrier materials are arranged so that their smooth surface is directed toward the outsole. The openings 135*a* to 135*d* are each bridged with a stabilization mesh 137*a*, 137*b*, 137*c*, and 137*e*, which form a stabilization structure in the area of the corresponding opening of the stabilization device 119. These stabilization meshes 137*a*-137*e* also act against the penetration of larger foreign objects up to the barrier material 33 or even farther, which could be felt as unpleasant by the user of the shoe.

Connection elements 139, provided on the axial ends of the stabilization part 119*b* on the midfoot side, must also be mentioned, which, during assembly of the stabilization device 119 from the three stabilization device parts 119*a* to 119*c*, can lie overlapping on the upper side of the stabilization-device parts 119*a* and 119*c* facing away from the outsole application side, in order to be attached there, for example, by welding or gluing.

FIG. 17 shows, in an enlarged view compared to FIG. 16, the two stabilization-device parts 119*a* and 119*b* before attaching to each other, whereby the openings 135*b* to 135*d* of the stabilization device part 119*c* on the forefoot side and the stabilization mesh structure situated in it can be seen in particular. It is also clear that the middle stabilization device part 119*b* shows raised frame and mesh parts on the longitudinal sides. The barrier material piece 33*a* to be placed on the stabilization device part 119*b*, is provided on its long sides with correspondingly raised side wings 141. Through these raised parts, both the shoe-stabilization part 119*b* and the barrier material piece 33*a*, an adjustment to the shape of the lateral midfoot sides is achieved. The remaining barrier material parts 33*b* to 33*d* are essentially flat, corresponding to the essentially flat design of the stabilization-device part 119*c* on the forefoot side.

It should be added in general here that the at least one opening 135*a*-135*d* of the stabilization device 119*b* and 119*c* is bounded by the frame 147 of the stabilization device 119 and not by the bars 37 present in the openings 135*a*-135*d*. The limitation edges 129*a*-129*c* depicted in FIG. 17 represent part of the corresponding frame 147 in this embodiment.

It is also possible, instead of several barrier-material parts 33*b*, 33*c*, 33*d*, to use a one-piece barrier-material part. The mounting protrusions 150 and/or limitation edges 129*a*-129*c* must be configured accordingly.

Another modification of the barrier-unit part provided for the midfoot area with the stabilization device part 119*b* and the barrier material part 33*a* is shown in FIGS. 18 and 19: in FIG. 18 in the finished mounted state and in FIG. 19 while these two parts are still separate from each other. In contrast to the embodiment in FIG. 17, in the modification of FIGS. 18 and 19, the stabilization part 119*b* provided for the midfoot area is only provided with an opening and a stabilization mesh 137*a* situated in it in the middle area, whereas the two wing parts 143 on the long sides of the stabilization device part 119*b* are designed to be continuous, i.e., have no opening, but are only provided on their bottom with stabilization ribs 145. The barrier-material piece 33*a* provided for this barrier-unit part is accordingly narrower than in the embodiments of FIGS. 18 to 19, because it does not require the side wings 141 according to FIG. 17.

While embodiments of the composite shoe sole according to the invention 105 were explained with reference to FIGS. 12 to 19, embodiments in details of footwear according to the invention will now be explained with reference to FIGS. 20 through 27, the footwear being constructed with the composite shoe sole according to the invention. FIGS. 20, 22, and 23 show a embodiment of the footwear according to the invention in which the shaft bottom has a shaft-mounting sole and also a functional-layer laminate, while FIGS. 24 and 25 show a embodiment of footwear according to the invention in which a shaft-bottom functional-layer laminate 237 simultaneously assumes the function of shaft-mounting sole 233. FIG. 26 shows another embodiment of the composite shoe sole 105.

In the two embodiments depicted in FIGS. 20 to 25, the shoe 101, in agreement with FIGS. 12 and 13*a*-*d*, has a shaft 103 that has an outer material layer 211 situated on the outside, a liner layer 213 situated on the inside, and a waterproof, water-vapor-permeable shaft functional layer 215 situated in between, for example, in the form of a membrane. The shaft functional layer 215 can be present in connection with the lining layer 213 as a two-ply laminate or as a three-ply laminate, whereby the shaft functional layer 215 is embedded between the liner layer 213 and a textile backing 214. The upper shaft end 217 is closed or open with respect to the foot-insertion opening 113 (FIG. 12), depending on whether the sectional plane of the cross-sectional view depicted in FIGS. 24 and 20 lies in the forefoot area or the midfoot area. On the shaft-end area 219 on the sole side, the shaft 103 is provided with a shaft bottom 221, with which the lower end of the shaft 103 on the sole side is closed. The shaft bottom 221 has a shaft-mounting sole 223, which is connected to the shaft-end area 219 on the sole side, which occurs in the embodiments according to FIGS. 20 through 25 by means of a Strobel seam.

In the case of the embodiments of FIGS. 20, 22, and 23, in addition to the shaft-mounting sole 233, a shaft-bottom functional layer laminate 237 is provided, which is arranged beneath the shaft-mounting sole 233 and extends beyond the periphery of the shaft-mounting sole 233 into the shaft-end area 219 on the sole side. The shaft-bottom functional layer laminate 237 can be a three-ply laminate, whereby the shaft-bottom functional layer 248 is embedded between a textile backing and another textile layer. It is also possible to provide the shaft-bottom functional layer 247 with the textile backing only. The outer material layer 211 in the shaft end area 219 on the sole side is shorter than the shaft functional layer 215, so that a protrusion of the shaft functional layer 215 with respect to the outer material layer 211 is created there and exposes the outer surface of the shaft functional layer 215. Mostly for mechanical tension relief of the protrusion of the shaft functional layer 215, a mesh band 241 or another material that can be penetrated with sealant is arranged between the end 238 of the outer material layer 211 on the sole side and the end 239 of the shaft functional layer 215 on the sole side, the long side of which, facing away from the Strobel seam 237, is joined by means of a first seam 243 to the end 238 of the outer material layer 211 on the sole side, but not to the shaft functional layer 215, and whose long side, facing the Strobel seam 235, is joined by means of Strobel seam 235 to the end 239 of the shaft functional layer 215 on the sole side and to the shaft mounting sole 233. The mesh band 241 preferably consists of a monofilament material, so that it has no water conductivity. The mesh band is preferably used for molded-on soles. If the composite sole is attached to the shaft by means of glue instead of the mesh band, the end 238 of the outer material layer 211 on the sole side can be attached by means of glue 249 to the lasting-shaft functional-layer laminate (FIG. 22). In the peripheral area 245, in which the shaft-bottom functional layer laminate 237 protrudes beyond the periphery of the shaft mounting sole 233, a sealing material 248 is arranged between the shaft-bottom functional layer 237 and the end 239 of the shaft functional layer 215 on the sole side, by means of which a waterproof connection is produced between the end 239 of the shaft functional layer 215 on the sole side and the peripheral layer 245 of the shaft-bottom functional layer laminate 237, this seal acting through the mesh band 241.

The mesh-band solution depicted in FIGS. 20, and 23 to 25 serves to prevent water that runs down or creeps down on the outer material layer 211, from reaching the Strobel seam 235 and advancing into the shoe interior from there. This is prevented by the fact that the end 238 of the outer material layer 211 on the sole side ends at a spacing from the end 239 of the shaft functional layer 215 on the sole side, which is bridged with the non-water-conducting mesh band 241, and the sealing material 247, is provided in the area of the protrusion of the shaft functional layer 215. The mesh-band solution is known from document EP 0,298,360 B1.

Instead of the mesh-band solution, all joining technologies used in the shoe industry for preferably waterproof joining of a shaft to the shaft bottom can be used. The depicted mesh-band solution and the lasting solution in FIG. 2 are example embodiments.

The shaft structure depicted in FIG. 24 agrees with the shaft structure shown in FIG. 20, with the exception that no separate shaft-mounting sole is provided there, but the shaft-bottom functional-layer laminate 237 simultaneously assumes the function of a shaft-mounting sole 233. According to it, the periphery of the shaft-bottom functional layer laminate 237 of the embodiment depicted in FIG. 24 is connected by a Strobel seam 235 to the end 239 on the sole side of the shaft functional layer 215 and the sealing material 248 is applied in the area of the Strobel seam 235, so that the transition between the end 239 on the sole side of the shaft functional layer 215 and the peripheral area of the shaft-bottom functional-layer laminate 237 is sealed completely, including the Strobel seam 235.

In both embodiments of FIGS. 20 and 24, an identically constructed composite show sole 105 can be used, as shown in these two diagrams. Since sectional views of shoes 101 are shown in the forefoot area in FIGS. 20 and 24, these diagrams are a sectional view of the forefoot area of the composite shoe sole 105, i.e., a sectional view along an intersection line running across the stabilization unit part 119*c* intended for the forefoot area with the barrier material piece 33*c* inserted in its openings 135*c*.

The sectional view of the composite shoe sole 105 accordingly shows the stabilization device part 119*c* with its opening 135*c*, a bar of the corresponding stabilization mesh 137*c* bridging this opening, the outward protruding frame 129*b*, the barrier material piece 33*c* inserted into the frame 129*b*, the damping sole part 121*b* on the top side of the stabilization device part 119*c*, and the outsole part 117*b* on the bottom of the stabilization device part 119*c*. To this extent, the two embodiments of FIGS. 20 to 24 correspond.

FIG. 21 shows an example of a barrier unit 35, in which a piece of barrier material 33 is provided on the bottom with at least one stabilization bar 37. On the surface area of the barrier material 33 opposite the stabilization bar 37, an adhesive 39 is applied, with which the barrier material 33 is joined to the waterproof, water-vapor-permeable shaft bottom 221, which is situated above the barrier unit 35 outside the composite shoe sole. The glue 39 is applied in such a way that the shaft bottom 221 is joined to the barrier material 33 wherever no material of the stabilization bar 37 is situated on the bottom of the barrier material 33. In this way, it is ensured that the water-vapor-permeability function of the shaft bottom 115 is interfered with by glue 39 only where the barrier material 33 cannot permit any water-vapor transport in any case, because of the arrangement of the stabilization bar 37.

Whereas the corresponding composite shoe sole 105 in FIGS. 20 and 24 is still separated from the corresponding shaft 103, FIGS. 22, 23, and 25 show, in an enlarged view and as a cutout, these two embodiments with the composite shoe sole 105 applied to the shaft bottom. In these enlarged views, the shaft-bottom functional layer 247 of the shaft-bottom functional-layer laminate 237, in all embodiments, is preferably a microporous functional layer, for example, made of expanded polytetrafluoroethylene (ePTFE). As already mentioned above, however, different types of functional layer materials can also be used.

In these enlarged cutout views of FIGS. 22, 23, and 25, the waterproof connection between the overlapping opposite ends of the shaft functional layer 215 and the shaft-bottom functional layer 247 created with the sealing material 248 can be seen particularly well. In addition, the involvement of a longitudinal mesh-band side in the Strobel seam 235 can also be seen more readily in FIGS. 20 and 24.

FIG. 22 shows an embodiment, in which the composite sole 105 according to the invention is attached by means of attaching glue 250 to the shaft bottom. The shaft functional-layer laminate 216 is a three-ply composite with a textile layer 214, a shaft functional layer 215, and a lining layer 213. The end 238 of the outer material layer 211 on the sole side is attached with lasting glue 249 to the shaft functional-layer laminate 216.

The attaching glue 250 is applied superficially to the surface of the composite sole, except for the trough holes 135 and the barrier material 33 arranged in the area of trough holes 135. When the composite sole is attached to the shaft bottom 221, the attaching glue 250 penetrates up to and partially into the shaft functional-layer laminate 216 and up to and partially into the edge areas of the shaft-bottom functional layer laminate 237.

FIG. 23 is a view of the shaft structure according to FIG. 20 with a molded-on composite shoe sole. The three-ply shaft-bottom functional-layer laminate 237 is then attached to the shaft mounting sole 233, so that the textile backing 246 faces the composite sole. This is advantageous, because the sole-molding material 260 penetrates more easily into the thin textile backing and can be anchored there and a firm connection to the shaft-bottom functional layer 237 is created.

The barrier unit with the at least one opening 135 in the at least one piece of barrier material 33 is present as a prefabricated unit and is inserted into the injection mold before the molding process. The sole-molding material 260 is molded onto the shaft bottom accordingly, advancing up to the shaft functional-layer laminate 216 through the mesh band 241.

FIG. 25 shows an enlarged and sectional view of FIG. 24. The composite sole 105 shows an additional embodiment of the barrier unit according to the invention. The shaft-stabilization device 119*c* forms a part of the composite sole 105 and does not extend here to the outer periphery of the composite sole 105. A piece of barrier material 33*c* is applied over the opening 135, so that the material 33*c* lies on the peripheral continuous flat limitation edge 130 of opening 135.

The composite sole 105 can be attached to the shaft bottom 221 with attaching glue 250 or molded on with sole-molding material 260 (as shown).

FIG. 25 also clearly shows that in the embodiment in which the shaft-bottom functional layer laminate 237 assumes the function of a shaft-mounting sole 233, the laminate comes to lie directly above the opposite top of the barrier material piece 33*c*, which is particularly advantageous. In this case, an air cushion that might adversely affect water-vapor removal cannot form between the shaft-bottom functional layer laminate 237 and the barrier material piece 33*c*, and the barrier material piece 33*c*, and especially the shaft-bottom functional layer 237, are situated particularly tight against the foot sole of the user of such a shoe, which improves water-vapor removal, which is also determined by the existing temperature gradient between the shoe interior and the shoe exterior.

FIG. 26 is a view of another embodiment of the composite sole according to the invention. The perspective view shows several openings 135 in the shoe-stabilization device 119, which are arranged from the toe area to the heel area of the composite sole. The stabilization material 33 is therefore also present in the heel area. The outsole is formed by the outsole parts 117.

FIG. 27 is a view of another embodiment of the composite sole according to the invention in a cross-sectional view. The composite sole 105 of this embodiment is quite similar to the composite sole depicted in FIG. 24. The composite sole 105 according to FIG. 27 has an outsole, in which a cross-section through the ball of the foot area of the composite sole 105 and therefore a cross-section through the corresponding outsole part 117*b* is shown in this diagram. However, the disclosure according to FIG. 27 also applies to the other areas of the composite sole 105, i.e., to its midfoot part and heel part. The outsole part 117*b* has a tread 153 that touches the floor during walking. The sectional view of the composite sole 105 of FIG. 27 shows the stabilization-device part 119*c* with its opening 135*c*, its upward protruding limitation edge 129*b*, the barrier material piece 33*c* inserted into the limitation edge 129*b*, the damping sole part 121*b* on the upper side of the stabilization device part 119*c*, and the outsole part 117*b* on the bottom of the stabilization part 119*c*. A support element 151 is applied to the bottom of the barrier material piece 133*c*. This extends from the side of the barrier material 33 facing the tread to the level of tread 153, so that the barrier material 33 is supported on the floor during walking by the support element 151. This means that a lower free end of the support element 151 in FIG. 27 touches this surface when the shoe provided with this composite sole stands on a surface. Through this support by the support element 151, during walking on such a surface, the barrier material piece 33*c* is held essentially in the position depicted in FIG. 27, so that it is prevented from bending under the load of the user of the shoe. Several support elements 151 can be arranged in opening 135*c*, in order to increase the support effect for the barrier material piece 33*c* and make its surface extent more uniform.

The support function can also be obtained by the fact that the stabilization bar 137 depicted in FIG. 24 is simultaneously formed as the support element 151 by allowing the stabilization bar 137*c* not to end at a spacing from the bottom of the outsole part 117*b* serving as the tread, but extending it to the level of this bottom. The stabilization bar 137*c* is then given the dual function of stabilizing and supporting the barrier-material piece 33*c*. For example, the stabilization bars 33*c* depicted in FIG. 10 or the stabilization mesh 37*d* depicted in FIG. 11 can be formed fully or partially as support elements 151.

With the sole structure according to the invention, a high water-vapor permeability is achieved, because, on the one hand, large-area trough holes in the composite shoe sole 105 are provided and these are closed with material of high water-vapor permeability, and because, at least in the area of the trough holes 31, there are no connections between the water-vapor-permeable barrier material 33 and the shaft-bottom functional layer 247 that prevent water-vapor exchange, and such a connection is, at most, present in the areas outside the trough holes 31 of the composite shoe sole 105 that do not participate actively in water-vapor exchange, such as the edge areas of the composite shoe sole 105. In the structure according to the invention, the shaft-bottom functional layer 247 is also arranged tightly in the foot, which leads to accelerated water-vapor removal.

The shaft-bottom functional-layer laminate 237 can be a multilayer laminate with two, three, or more layers. At least one functional layer is contained with at least one textile support for the functional layer, whereby the functional layer can be formed by a waterproof, water-vapor-permeable membrane 247, which is preferably microporous.

TEST METHODS

Thickness

The thickness of the barrier material according to the invention is tested according to DIN ISO 5084 (10/1996).

Puncture Resistance

The puncture resistance of the textile fabric can be measured with a measurement method used by the EMPA ([Swiss] Federal Material Testing and Research Institute), using a test device of the Instrom tensile-testing machine (model 4465). A round textile piece 13 cm in diameter is punched out with a punch and attached to a support plate in which there are 17 holes. A punch, on which 17 spike-like needles (sewing needle type 110/18) are attached, is lowered at a speed of 1000 mm/min far enough that the needles pass through the textile piece into the holes of the support plate. The force for puncturing the textile piece is measured by means of a measurement sensor (a force sensor). The result is determined from a test of three samples.

Waterproof Functional Layer/Barrier Unit

A functional layer is considered "waterproof," optionally including the seams provided on the functional layer, when it guarantees a water-penetration pressure of at least $1\times10^4$ Pa. The functional-layer material preferably guarantees a water penetration pressure of more than $1\times10^5$ Pa. The water penetration pressure is then measured according to a test method in which distilled water, at 20±2° C., is applied to a sample of 100 $cm^2$ of the functional layer with increasing pressure. The pressure increase of the water is 60±3 cm $H_2O$ per minute. The water-penetration pressure corresponds to the pressure at which water first appears on the other side of the sample. Details concerning the procedure are provided in ISO standard 0811 from the year 1981.

Waterproof Shoe

Whether a shoe is waterproof can be tested, for example, with a centrifugal arrangement of the type described in U.S. Pat. No. 5,329,807.

Water-Vapor Permeability of the Barrier Material

The water-vapor permeability values of the barrier material according to the invention are tested by means of the so-called beaker method according to DIN EN ISO 15496 (09/2004).

Water-Vapor Permeability of the Functional Layer

A functional layer is considered "water-vapor-permeable", if it has a water-vapor permeability number, Ret, of less than 150 $m^1\times Pa\times W^{-1}$. The water-vapor permeability is tested according to the Hohenstein skin model. This test method is described in DIN EN 31092 (02/94) or ISO 11092 (1993).

Water-Vapor Permeability of the Shoe-Bottom Structure According to the Invention In an embodiment of the footwear according to the invention with a shoe-bottom structure that includes the composite shoe sole and the shaft-bottom functional layer or the shaft-bottom functional layer laminate situated above it, the shoe-bottom structure has a water-vapor permeability (MVTR—moisture vapor transmission rate) in the range from 0.4 g/h to 3 g/h, which can lie in the range from 0.8 g/h to 1.5 g/h and in a practical embodiment, is 1 g/h.

The extent of water-vapor permeability of the shoe-bottom structure can be determined with the measurement method documented in EP 0,396,716 B1, which is conceived for measuring the water-vapor permeability of an entire shoe. To measure the water-vapor permeability of only the shoe-bottom structure of a shoe, the measurement method according to EP 0,396,716 B1 can also be used, in which the measurement is made with the measurement layout depicted in FIG. 1 of EP 0,396,716 B1 in two consecutive measurement scenarios, namely once for the shoe with a water-vapor-permeable shoe-bottom structure and another time for an otherwise identical shoe with a water-vapor-impermeable shoe-bottom structure. From the difference between the two measurements, the percentage of water-vapor permeability that is attributed to the water-vapor permeability of the water-vapor-permeable shoe-bottom structure can be determined.

In each measurement scenario, using the measurement method according to EP 0,396,716 B1, the following sequence of steps was used:

a) Conditioning of the shoe by leaving it in an air-conditioned room (23° C., 50% relative humidity) for at least 12 hours.
b) Removal of the insert sole (foot bed)
c) Lining the shoe with a waterproof, water-vapor-permeable lining material adapted to the shoe interior, which, in the area of the foot insertion opening of the shoe, can be sealed waterproof and water-vapor-tight with a waterproof, water-vapor-impermeable sealing plug (for example, made of Plexiglas and with an inflatable sleeve).
d) Filling water into the lining material and closing the foot-insertion opening of the shoe with the sealing plug.
e) Preconditioning the water-filled shoe by leaving it for a predetermined period (3 hours), during which the temperature of the water is kept constant at 35° C. The climate of the surrounding room is also kept constant at 23° C. and 50% relative humidity. The shoe is blown against frontally by a fan during the test with a wind velocity, on average, of at least 2 m/s to 3 m/s (to destroy a resting air layer that forms around the standing shoe, which would cause a significant resistance to water-vapor passage).
f) Reweighing the shoe filled with water and sealed with the sealing plug after preconditioning (result: weight m2 (g))
g) Standing again in a test phase of 3 hours under the same conditions as in step e)
h) Reweighing the sealed water-filled shoe (result: weight m3 (g)) after the 3-hour test phase
i) Determining the water-vapor permeability of the shoe from the amount of water vapor that escapes through the shoe during the test time of 3 hours (m2−m3) (g) according to the relation M=(m2−m3) (g)/3 (h).

After both measurement scenarios have been conducted, in which the water-vapor-permeability values are measured, on the one hand, for the entire shoe with a water-vapor-permeable shoe-bottom structure (value A) and, on the other hand, for the entire shoe with the water-vapor-impermeable[1] shaft-bottom structure (value B), the water-vapor-permeability value for the water-vapor-permeable shoe-bottom structure alone can be determined from the difference A-B.

[1] Translator's Note: The German word, "wasserdampfdurchlässigen" should be "wasserdampfundurchlässigen. Changed in translation.

It is important during measurement of water-vapor permeability of the shoe with the water-vapor-permeable shoe-bottom structure to avoid a situation where the shoe or its sole stands directly on a closed substrate. This can be achieved by raising the shoe or by positioning the shoe on a mesh structure, so that it is ensured that the ventilation air stream can flow along—or, better beneath—the outsole.

It is useful in each test layout to make repeated measurements for a certain shoe and to consider the averages from them, in order to be able to estimate the measurement scatter better. At least two measurements should be made for each shoe with the measurement layout. In all measurements, a natural fluctuation of the measurement results of ±0.2 g/h around the actual value, for example, 1 g/h, should be assumed. For this example, measured values between 0.8 g/h and 1.2 g/h could therefore be determined for the identical shoe. Influencing factors for these fluctuations could be the person performing the test or the quality of sealing on the upper shaft edge. By determining several individual measured values for the same shoe, a more exact picture of the actual value can be obtained.

All values for water-vapor permeability of the shoe-bottom structure are based on a normally cut men's shoe of size 43 (French size), whereby the statement of the size is not standardized and shoes of different manufacturers could come out differently.

There are Essentially Two Possibilities for the Measurement Scenarios:

1. Measurement of shoes with a water-vapor-permeable shaft, having
   1.1 a water-vapor-permeable shoe-bottom structure;
   1.2 a water-vapor-impermeable shoe-bottom structure;
2. Measurement of shoes with a water vapor-impermeable shaft, having
   2.1 a water-vapor-permeable shoe-bottom structure,
   2.2 a water-vapor-impermeable shoe-bottom structure.

Elongation and Tensile Strength

An elongation and tensile-strength test was conducted according to DIN EN ISO 13934-1 of 04/1999. Instead of five samples per direction, three were used. The spacing of the clamping jaws was 100 mm in all samples.

Abrasion

With respect to abrasion resistance, two measurement methods were used for the abrasion measurements to obtain the abrasion values in the comparison table. In the first place, a Martindale abrasion tester was used ("abrasion carbon" in the table), in which, according to Standard DIN EN ISO 124940-1; -2 (04/1999), the sample being tested is rubbed against sandpaper. Three deviations from the standard are then made: first, sandpaper with grain 180 plus standard foam is tightened in the sample holder. Second, standard felt from the test sample is tightened in the sample table. Third place, the sample is inspected every 700 passes and the sandpaper is changed. On the other hand, the abrasion resistance was tested in wet samples (in the table "abrasion wet") according to DIN EN ISO 12947-1, -2, -4; with the deviation from the standard that the sample table with standard felt and standard wool were saturated with distilled water every 12,800 passes.

In the abrasion tests, friction movements according to Lissajous figures were conducted. Lissajous figures represent a periodically repeating overall picture during a corresponding choice of the ratio of participating frequencies, which consist of individual figures offset relative to each other. Passage through one of these individual figures is referred to as a pass in connection with the abrasion test. In all materials 1 to 5, it was measured after how many passes the first holes occurred in the corresponding material and the material had therefore been scraped through. In the comparison table, two pass values are found for each of the materials, which were formed from the two abrasion tests with the same material.

Hardness

Hardness test according to Shore A and Shore D (DIN 53505, ISO 7819-1, DIN EN ISO 868)

Principle:

"Hardness according to Shore" is understood to mean the resistance to penetration of an object of a specific shape and defined spring force. The Shore hardness is the difference between the numerical value 100 and the penetration depth of the penetration object in mm under the influence of the test force divided by the scale value 0.025 mm.

During testing according to Shore A, a truncated cone with an opening angle of 35° is used as the penetration object, and in Shore D, a cone with an opening angle of 30° and a tip radius of 0.1 mm is used. The penetration objects consist of polished, tempered steel.

Measurement equation:

$$HS = 100 - \frac{h}{0.025}$$

$$F = 550 + 75HSA$$

$$F = 445HSD$$

H in mm, F in mN

Area of Application:

Because of the different resolution of the two Shore hardness methods in different hardness ranges, materials with a Shore A hardness >80 are appropriately tested according to Shore D and materials with a Shore D hardness <30 according to Shore A.

| Hardness scale | Application |
|---|---|
| Shore A | Soft rubber, very soft plastic |
| Shore D | Hard rubber, soft thermoplastic material |

DEFINITIONS

Barrier Material:

A material that enables the shoe or parts/materials present in the shoe, such as outer material, sole, membrane, to be mechanically protected and resist deformation, and also penetration of external objects/foreign bodies, for example, through the sole, while retaining high water-vapor transport, i.e., high climate comfort in the shoe. The mechanical protection and resistance to deformation are mostly based on limited elongation of the barrier material.

Fiber Composite:

General term for a composite of fibers of any type. This includes leather, non-woven materials, or knits consisting of metal fibers, under some circumstances, also in a blend with textile fibers, also yarns and textiles produced from yarns (fabrics).

A fiber composite must have at least two fiber components. These components can be fibers (for example, staple fibers), filaments, fiber elements, yarns, strands, etc. Each fiber component consists either of a material or contains at least two different material fractions, one fiber part softening/melting at a lower temperature than the other fiber part (bico). Such bico fibers can have a core-shell structure—a core fiber part enclosed with a shell fiber part here, a side-to-side structure or an island-in-the-sea structure. Such processing and machines are available from Rieter Ingolstadt, Germany and/or Schalfhorst in Monchengladbach, Germany.

The fibers can be simply spun, multifilament, or several torn fibers with frayed ends looped to one another.

The fiber components can be distributed uniformly or non-uniformly in the fabric composite.

The entire fabric composite must preferably be temperature-stable, but at least to 180° C. A uniform and smooth surface on at least one side of the fiber composite is achieved by means of pressure and temperature. This smooth surface points "downward" to the ground/floor, so that a situation is achieved in which particles/foreign objects bounce off the smooth surface better or are repelled more simply.

The properties of the surface or overall structure of the fiber composite or stabilization material depend on the selected fibers, the temperature, the pressure, and the period over which the fiber composite was exposed to temperature and pressure.

Non-Woven Material:

Here, the fibers are laid on a conveyor belt and tangled.

Lay:

A fishnet or sieve structure of the fibers. See EP 1,294,656 from Dupont.

Felt:

Wool fibers that are opened and hooked by mechanical effects.

Woven Fabric:

A fabric produced with warp and weft threads.

Woven and Knit Fabric:

A fabric formed by meshes

Melting Point:

The melting point is the temperature at which the fiber component or fiber part becomes liquid. Melting point is understood, in the field of polymer or fiber structures, to mean a narrow temperature range in which the crystalline areas of the polymer or fiber structure melt and the polymer converts to a liquid state. It lies above the softening temperature range and is a significant quantity for partially crystallized polymers. Molten means the change of state of aggregation of a fiber or parts of a fiber at a characteristic temperature from solid to viscous/free-flowing.

Softening Temperature Range:

The second fiber component of the second fiber part must only become soft/plastic, but not liquid. This means the softening temperature used lies below the melting point at which the components/fractions flow. The fiber component or parts of it are preferably softened, so that the more temperature-stable component is embedded or incorporated in the softened parts.

The first softening temperature range of the first fiber component lies higher than the second softening temperature range of the second fiber component or the second fiber part of the second fiber component. The lower limit of the first softening range can lie below the upper limit of the second softening temperature range.

Adhesive Softening Temperature:

The temperature, at which softening of the second fiber component or the second fiber part occurs, at which its material exerts a gluing effect, so that at least part of the fibers of the second fiber component are thermally bonded to one another by gluing, a bonding stabilization of the fiber component occurs, which is greater than the bonding obtained in a fiber composite with the same materials for the two fiber components by purely mechanical bonding, for example, by needle bonding of the fiber composite. The adhesive softening temperature can also be chosen in such a way that softening of the fibers of the second fiber component occurs to an extent that gluing develops not only of fibers of the second fiber component to one another, but also partial or full enclosure of the individual sites of the fibers of the first fiber composite with softened material of the fibers of the second fiber composite occurs, i.e., partial or full embedding of those sites of the fibers in the first fiber composite in the material of the fibers of the second fiber component, so that a correspondingly increased stabilization bonding of the fiber composite is produced.

Temperature Stability:

If the stabilization device is molded-on, the barrier material must be temperature-stable for molding. The same applies to molding (about 170° C.-180° C.) or vulcanization of the shoe sole. If the stabilization device is to be molded-on, the barrier material must have a structure such that the stabilization device can at least penetrate into the structure of the barrier material, or optionally penetrate through it.

Functional Layer/Membrane:

The shaft-bottom functional layer, and optionally the shaft functional layer can be formed by a waterproof, water-vapor-permeable coating or a waterproof, water-vapor-permeable membrane, which can either be a microporous membrane or a membrane having no pores. In one embodiment of the invention, the membrane is expanded polytetrfluoroethylene (ePTFE).

Appropriate materials for a waterproof, water-vapor-permeable functional layer include: polyurethane, polypropylene, polyester, including polyether-ester, and laminates thereof, as described in documents U.S. Pat. No. 4,725,418 and U.S. Pat. No. 4,493,870. However, expanded microporous polytetrafluoroethylene (ePTFE) is particularly preferred, as described, for example, in documents U.S. Pat. No. 3,953,366 and U.S. Pat. No. 4,187,390, and expanded polytetrafluoroethylene provided with hydrophilic impregnation agents and/or hydrophilic layers; see, for example, document U.S. Pat. No. 4,194,041. A "microporous functional layer" is understood to mean a functional layer whose average pore size lies between about 0.2 μM and about 0.3 μm.

The pore size can be measured with a Coulter Porometer (trade name), which is produced by Coulter Electronics, Inc., Hialeah, Fla., USA.

Barrier Unit:

The barrier unit is formed by the barrier material, and optionally by the stabilization device in the form of at least one bar and/or frame. The barrier unit can be present in the form of a prefabricated component.

Composite Shoe Sole:

A composite shoe sole consists of barrier material and at least one stabilization device and at least one outsole, as well as optionally additional sole layers, whereby the barrier material closes at least a trough hole extending through the thickness of the composite shoe sole.

Trough Hole:

A trough hole is an area of the composite shoe sole, through which water-vapor transport is possible. The outsole and the stabilization devices each have passage openings that overall form a trough hole through the entire thickness of the composite shoe sole. The trough hole is therefore formed by the intersection surface of the two passage openings. Any bars present are arranged within the peripheral edge of the corresponding trough hole and do not form a limitation of the trough hole. The area of the trough hole is determined by subtracting the area of all bridging bars, since these bar surfaces block water-vapor transport and therefore do not represent trough hole surfaces.

Stabilization Device:

The stabilization device acts as additional stabilization of the barrier material and is formed and applied to the barrier material in such a way that the water-vapor permeability of the barrier material is only slightly influenced, if at all. This is achieved by the fact that only a small area of the barrier material is covered by the stabilization device. The stabilization device is preferably directed downward toward the floor. The stabilization device is primarily assigned not a protective function, but a stabilization function.

Opening of the Stabilization Device:

The at least one opening of the stabilization device is bounded by its at least one frame. The area of an opening is determined by subtracting the area of all bridging bars.

Shoe:

A foot covering consisting of a composite shoe sole and a closed upper (shaft).

Shoe Bottom:

The shoe bottom includes all layers beneath the foot.

Thermal Activation:

Thermal activation occurs by exposing the fiber composite to energy, which leads to an increase in temperature of the material to the softening temperature range.

Water-Permeable Composite Shoe Sole:

A composite shoe sole is tested according to the centrifuge arrangement of the type described in U.S. Pat. No. 5,329,807. Before testing, it must be ensured that any shaft-bottom functional layer present is made water-permeable. A water-permeable composite shoe sole is assumed if this test is not passed. If necessary, the test is conducted with a colored liquid, in order to show the path of electricity through the composite shoe sole.

Laminate:

Laminate is a composite consisting of a waterproof, water-vapor-permeable functional layer with at least one textile layer. The at least one textile layer, also called a backing, primarily serves to protect the functional layer during processing. We speak here of a two-ply laminate. A three-ply laminate consists of a waterproof, water-vapor-permeable functional layer embedded between two textile layers, spot-gluing being applied between these layers.

Waterproof Functional-Layer/Barrier Unit:

A functional layer is considered "waterproof," optionally including seams provided on the functional layer, if it guarantees a water-penetration pressure of at least $1\times10^4$ Pa.

Top of the Composite Shoe Sole:

The "top" of the composite shoe sole is understood to mean the surface of the composite shoe sole that lies opposite the shaft bottom.

Outsole:

"Outsole" is understood to mean the part of the composite shoe sole that touches the floor/ground or produces the main contact with the floor/ground.

LIST OF REFERENCE NUMBERS

1 Fiber composite
2 First fiber component
3 Second fiber component
4 Core
5 Shell
6 Connection
21 Composite shoe sole
23 Outsole
25 Shoe-stabilization device
27 Outsole opening
29 Shoe-stabilization device opening
31 Trough hole
33 Barrier material
  33*a* Barrier material
  33*b* Barrier material
  33*c* Barrier material
  33*d* Barrier material
35 Barrier unit
37 Stabilization bar
  37*a* Individual bar
  37*b* Individual bar
  37*c* Individual bar
  37*d* Stabilization mesh
39 Glue
43 Circular surface
101 Shoe
103 Shaft
105 Composite shoe sole
107 Forefoot area
109 Midfoot area
111 Heel area
113 Foot insertion opening
115 Shaft bottom
117 Multipart outsole
  117*a* Multipart outsole heel area
  117*b* Multipart outsole ball of foot area
  117*c* Multipart outsole toe area
119 Stabilization device
  119*a* Heel area
  119*b* Midfoot area
  119*c* Forefoot area
121 Damping sole part
  121*a* Damping sole part heel area
  121*b* Damping sole part midfoot area
[123] Outsole openings
  123*a* Heel area
  123*b* Midfoot area
  123*c* Forefoot area
125 Passage opening in the heel area 119*a* of a stabilization device
[127] Openings in the damping sole part
  127*a* Heel area
  127*b* Midfoot area
  127*c* Forefoot area
[129] Limitation edge of the shoe stabilization device
  129*a* Midfoot area
  129*b* Forefoot area
  129*c* Forefoot area
131 Protrusions
133 Recesses
[135] Stabilization-device openings
  135*a* Midfoot area
  135*b* Forefoot area
  135*c* Forefoot area
  135*d* Forefoot area
[137] Stabilization mesh
  137*a* Midfoot area
  137*b* Forefoot area
  137*c* Forefoot area
  137*d* Forefoot area
139 Connection element
141 Side wings
143 Wing parts stabilization device
145 Stabilization rib
147 Fraying of stabilization device
150 Support protrusion
151 Support element
153 Tread
211 Outer material layer
213 Lining layer
214 Textile layer
215 Shaft functional layer

216 Shaft functional-layer laminate
217 Upper shaft end
219 Shaft-end area on the sole side
221 Shaft bottom
233 Shaft mounting sole
235 Strobel seam
237 Shaft-bottom functional-layer laminate
238 End of the outer material layer on the sole side
239 End of the shaft functional layer on the sole side
241 Seam band
243 First seam
244 Textile layer
245 Peripheral layer
246 Textile backing
247 Membrane
248 Sealing material
249 Lasting glue
250 Attaching glue
260 Sole-molding material

COMPARATIVE TABLE

| Material type | Sole split leather | Non-woven material, only needle-bonded | Woven material, only needle-bonded | Non-woven material, needle-bonded and thermally bonded | Non-woven material, needle-bonded, thermally bonded; thermal surface compression with 3.3 N/cm$^2$/230° C./10 s |
|---|---|---|---|---|---|
| Material number | Material 1 | Material 2 | Material 3 | Material 4 | Material 5 |
| Material | 100% leather | 100% PES | 100% PES | PES + bico PES total 100% PES | PES + bico PES total 100% PES |
| Basis weight (g/m$^2$) | 2383 | 206 | 125 | 398 | 397 |
| Thickness (mm) | 3.36 | 2.96 | 2.35 | 1.71 | 1.46 |
| MVTR (g/m$^2$ 24 h) (1) | 3323 | 8086 | 9568 | 9459 | 9881 |
| Longitudinal elongation at 50 N (%) | 1 | 34 | 55 | 0 | 0 |
| Longitudinal elongation at 100 N (%) | 2 | 48 | 79 | 1 | 0 |
| Longitudinal elongation at 150 N (%) | 2 | 59 | 104 | 1 | 0 |
| Longitudinal tensile force (N) | 3106 | 324 | 152 | 641 | 821 |
| Longitudinal tensile elongation (%) | 40 | 94 | 107 | 26 | 27 |
| Transverse elongation at 50 N (%) | 0 | 32 | 46 | 0 | 0 |
| Transverse elongation at 100 N (%) | 1 | 43 | 63 | 1 | 0 |
| Transverse elongation at 150 N (%) | 1 | 52 | 75 | 1 | 0 |
| Transverse tensile force (N) | 4,841 | 410 | 252 | 884 | 742 |
| Transverse tensile elongation (%) | 43 | 92 | 99 | 35 | 32 |
| Puncture resistance (N) | 857 | 5 | 6 | 317 | 291 |
| Abrasion wet (passes) (2) | 25,600/30,100 | 20,600/20,600 | 20,700/16,500 | 70,200/70,200 | 614,000/704,000 |
| Abrasion carbon (passes) (2) | about 35,000 | 1,570/1,600 | 452/452 | 7,700/7,700 | 14,000/15,400 |

(1) DIN EN ISO 15496 (September 2004)
(2) DIN EN ISO 12947-1, -2 (April 1999)

Men's shoe size 42/43 (French)

Test time: 3 hours

All shafts constructed identically, i.e., scatter only through natural scatter of the materials (leather, textile, etc.)

Shaft can be designed waterproof

Constant water amount in all shoes

Insert soles removed for the test

Shoe-bottom structures in numbers 2 and 3 comparable: In no. 1 only the outsole is closed, i.e., it has no openings

| Shoe number | Repetition measurements | Sole water-vapor-permeable? YES/NO | Air stream over the shaft and under the sole | Weight m2 (g) before beginning of test | Weight m3 (g) after the end of the test | Total shoe water-vapor permeability MVTR = (m2 − m3)/test time (g/h) | Average value of repetition measurements per shoe number MVTR (g/h) | Water-vapor permeability of the shoe-bottom structure (g/h) |
|---|---|---|---|---|---|---|---|---|
| 1 | 1 | No | Yes | 1106.66 | 1097.55 | 3.0 | 3.1 | 0 |
| 1 | 2 | No | Yes | 1103.58 | 1095.03 | 2.8 | | |
| 1 | 3 | No | Yes | 1102.98 | 1094.63 | 2.8 | | |
| 1 | 4 | No | Yes | 1112.44 | 1102.54 | 3.3 | | |
| 1 | 5 | No | Yes | 1143.9 | 1133.75 | 3.4 | | |
| 1 | 6 | No | Yes | 1108.58 | 1098.42 | 3.4 | | |
| 1 | 7 | No | Yes | 1102.62 | 1094.15 | 2.8 | | |
| 1 | 8 | No | Yes | 1101.78 | 1093.16 | 2.9 | | |
| 1 | 9 | No | Yes | 1117.55 | 1107.86 | 3.2 | | |
| 2 | 1 | Yes | Yes | 1179.2 | 1167.06 | 4.0 | 4.0 | 4.0 − 3.1 = 0.9 |
| 2 | 2 | Yes | Yes | 1156.7 | 1144.85 | 4.0 | | |
| 2 | 3 | Yes | Yes | 1144.65 | 1132.97 | 3.9 | | |
| 2 | 4 | Yes | Yes | 1159.46 | 1148.3 | 3.7 | | |
| 2 | 5 | Yes | Yes | 1153.56 | 1142.5 | 3.7 | | |
| 2 | 6 | Yes | Yes | 1175.88 | 1163.36 | 4.2 | | |
| 2 | 7 | Yes | Yes | 1173.78 | 1160.84 | 4.3 | | |
| 2 | 8 | Yes | Yes | 1165.54 | 1153.05 | 4.2 | | |
| 3 | 1 | Yes | Yes | 1153 | 1140 | 4.3 | 4.3 | 4.3 − 3.1 = 1.2 |
| 3 | 2 | Yes | Yes | 1168.42 | 1156.17 | 4.1 | | |
| 3 | 3 | Yes | Yes | 1160.6 | 1146.98 | 4.5 | | |
| 3 | 4 | Yes | Yes | 1183.8 | 1170.5 | 4.4 | | |

The invention claimed is:

1. A water-vapor-permeable composite shoe sole with an upper side, having:

at least one through hole extending through the thickness of the composite shoe sole;

a barrier unit with an upper side forming at least partially the upper side of the composite shoe sole, and comprising a water-vapor-permeable barrier material against penetration of foreign objects, by means of which the at least one through hole is closed in a water-vapor-permeable manner;

a mechanical stabilization device in communication with the barrier material which is constructed with at least one stabilization bar, which is arranged at least on one surface of the barrier material and at least partially bridges at least one through hole;

and at least one outsole part arranged beneath the barrier unit, wherein the outsole part comprises a first material and the stabilization device comprises a second material different from the first material.

2. A composite shoe sole according to claim 1, whose barrier unit is water-permeable.

3. A composite shoe sole according to claim 1, which is water-permeable.

4. A composite shoe sole according to claim 1, wherein the at least one stabilization device is oriented so that at least 15% of the surface of the forefoot area of the composite shoe sole is water-vapor-permeable.

5. A composite shoe sole according to claim 4, wherein the at least one stabilization device is oriented so that at least 25% of the surface of the forefoot area of the composite shoe sole is water-vapor-permeable.

6. A composite shoe sole according to claim 5, wherein at least 40% of the surface of the forefoot area of the composite shoe sole is water-vapor-permeable.

7. A composite shoe sole according to claim 6, wherein at least 50% of the surface of the forefoot area of the composite shoe sole is water-vapor-permeable.

8. A composite shoe sole according to claim 7, wherein at least 60% of the surface of the forefoot area of the composite shoe sole is water-vapor-permeable.

9. A composite shoe sole according to claim 8, wherein at least one stabilization device is oriented so that at least 75% of the surface of the forefoot area of the composite shoe sole is water-vapor-permeable.

10. A composite shoe sole according to claim 1, wherein at least one stabilization device is oriented so that at least 15% of the surface of the midfoot area of the composite shoe sole is water-vapor-permeable.

11. A composite shoe sole according to claim 1, wherein at least one stabilization device is oriented so that at least 25% of the surface of the midfoot area of the composite shoe sole is water-vapor-permeable.

12. A composite shoe sole according to claim 1, wherein at least one stabilization device is oriented so that at least 40% of the surface of the midfoot area of the composite shoe sole is water-vapor-permeable.

13. A composite shoe sole according to claim 1, wherein at least one stabilization device is oriented so that at least 50% of the surface of the midfoot area of the composite shoe sole is water-vapor-permeable.

14. A composite shoe sole according to claim 1, wherein at least one stabilization device is oriented so that at least 60% of the surface of the midfoot area of the composite shoe sole is water-vapor-permeable.

15. A composite shoe sole according to claim 1, wherein at least one stabilization device is oriented so that at least 75% of the surface of the midfoot area of the composite shoe sole is water-vapor-permeable.

16. A composite shoe sole according to claim 1, wherein at least one stabilization device is oriented so that at least 15% of the surface of the front-half of the longitudinal extent of the composite shoe sole is water-vapor-permeable.

17. A composite shoe sole according to claim 16, wherein at least one stabilization device is oriented so that at least 25% of the surface of the front-half of the longitudinal extent of the composite shoe sole is water-vapor-permeable.

18. A composite shoe sole according to claim 17, wherein at least one stabilization device is oriented so that at least 40% of the surface of the front-half of the longitudinal extent of the composite shoe sole is water-vapor-permeable.

19. A composite shoe sole according to claim 18, wherein at least one stabilization device is oriented so that at least 50% of the surface of the front-half of the longitudinal extent of the composite shoe sole is water-vapor-permeable.

20. A composite shoe sole according to claim 19, wherein at least one stabilization device is oriented so that at least 60% of the surface of the front-half of the longitudinal extent of the composite shoe sole is water-vapor-permeable.

21. A composite shoe sole according to claim 1, wherein at least one stabilization device is oriented so that at least 75% of the surface of the front-half of the longitudinal extent of the composite shoe sole is water-vapor-permeable.

22. A composite shoe sole according to claim 1, wherein at least one stabilization device is oriented so that at least 15% of the longitudinal extent of the composite shoe sole minus the heel area is water-vapor-permeable.

23. A composite shoe sole according to claim 22, wherein at least one stabilization device is oriented so that at least 25% of the longitudinal extent of the composite shoe sole minus the heel area is water-vapor-permeable.

24. A composite shoe sole according to claim 23, wherein at least one stabilization device is oriented so that at least 40% of the longitudinal extent of the composite shoe sole minus the heel area is water-vapor-permeable.

25. A composite shoe sole according to claim 24, wherein at least one stabilization device is oriented so that at least 50% of the longitudinal extent of the composite shoe sole minus the heel area is water-vapor-permeable.

26. A composite shoe sole according to claim 25, wherein at least one stabilization device is oriented so that at least 60% of the longitudinal extent of the composite shoe sole minus the heel area is water-vapor-permeable.

27. A composite shoe sole according to claim 26, wherein at least one stabilization device is oriented so that at least 75% of the longitudinal extent of the composite shoe sole minus the heel area is water-vapor-permeable.

28. A composite shoe sole according to claim 1, with a number of through holes, each closed by a piece of barrier material.

29. A composite shoe sole according to claim 1, with a number of through holes closed overall by one piece of barrier material.

30. A composite shoe sole according to claim 1, in which the barrier unit has at least one stabilization bar on the side of the barrier unit facing the outsole.

31. A composite shoe sole according to claim 1, in which the stabilization device with the at least one stabilization bar is not a component of the at least one outsole part.

32. A composite shoe sole according to claim 1, in which the stabilization device with the at least one stabilization bar has a spacing from the floor.

33. A composite shoe sole according to claim 32, in which the spacing corresponds to the thickness of the at least one outsole part.

34. A composite shoe sole according to claim 1, whose outsole part has a first material, and the stabilization device has a second material different from the first material, the second material being harder (according to Shore) than the first material.

35. A composite shoe sole according to claim 1, in which the barrier material is designed in the form of a fiber composite.

36. A composite shoe sole according to claim 1, in which the stabilization device is designed in one piece and carries barrier material that closes all the through holes.

37. A composite shoe sole according to claim 1, in which the stabilization device is designed in several pieces, in which the pieces are at least assigned to at least one through hole and each carry a piece of barrier material that closes at least one through hole.

38. A composite shoe sole according to claim 1, whose stabilization device is provided with at least one opening, which forms at least one part of the through hole and is closed with barrier material.

39. A composite shoe sole according to claim 38, whose stabilization device has a number of openings that are closed overall with one piece of barrier material.

40. A composite shoe sole according to claim 38, whose stabilization device has a number of openings that are each closed with a piece of barrier material.

41. A composite shoe sole according to claim 1, whose stabilization device has at least one stabilization frame that stabilizes at least the composite shoe sole.

42. A composite shoe sole according to claim 41, whose stabilization frame is fit into the at least one through hole or into at least one of the through holes of the composite shoe sole.

43. A composite shoe sole according to claim 38, in which at least one opening has an area of at least 1 $cm^2$.

44. A composite shoe sole according to claim 43, in which at least one opening has an area of at least 5 $cm^2$.

45. A composite shoe sole according to claim 44, in which at least one opening has an area of at least 20 $cm^2$.

46. A composite shoe sole according to claim 44, in which at least one opening has an area of at least 40 $cm^2$.

47. A composite shoe sole according to claim 1, whose stabilization device has several stabilization bars that form a structure on at least one surface of the barrier material.

48. A composite shoe sole according to claim 1, whose stabilization device is constructed with at least one thermoplastic material.

49. A composite shoe sole according to claim 1, in which the stabilization device and the barrier material are at least partially joined to each other.

50. A composite shoe sole according to claim 49, in which the stabilization device and the barrier material are joined to each other by means of at least one joining technique, chosen from gluing, welding, molding-on, molding around, vulcanizing on, and vulcanizing around.

* * * * *